US011497979B2

(12) United States Patent
Castillo

(10) Patent No.: US 11,497,979 B2
(45) Date of Patent: Nov. 15, 2022

(54) GOLF ALIGNMENT ROD

(71) Applicant: Jose A. Castillo, Hedgesville, WV (US)

(72) Inventor: Jose A. Castillo, Hedgesville, WV (US)

( * ) Notice: Subject to any disclaimer, the term of this patent is extended or adjusted under 35 U.S.C. 154(b) by 0 days.

(21) Appl. No.: 17/324,002

(22) Filed: May 18, 2021

(65) Prior Publication Data

US 2021/0354020 A1 Nov. 18, 2021

Related U.S. Application Data

(60) Provisional application No. 63/026,183, filed on May 18, 2020.

(51) Int. Cl.
*A63B 69/36* (2006.01)

(52) U.S. Cl.
CPC ..... *A63B 69/3667* (2013.01); *A63B 2210/58* (2013.01); *A63B 2225/09* (2013.01)

(58) Field of Classification Search
CPC ..... A63B 69/3667; A63B 2210/58; A63B 2225/09; A63B 2071/0694; A63B 2210/54
USPC ..... 473/207, 218, 266, 270, 271–273
See application file for complete search history.

(56) References Cited

U.S. PATENT DOCUMENTS 2,169,407 A * 8/1939 Crowley ..... A63B 69/3667 473/272
2,439,346 A 4/1948 Nash
3,229,981 A 1/1966 Taber
4,257,608 A 3/1981 Funk
4,384,718 A 5/1983 Cachola
4,516,779 A * 5/1985 Miller ..... A63B 69/3676 473/265
4,736,952 A 4/1988 Taft
4,779,872 A 10/1988 Bisbee
5,322,288 A 6/1994 Amis
5,350,177 A * 9/1994 Furbush, Jr. ..... A63B 69/3621 473/218
D351,446 S 10/1994 Niedworok
5,464,220 A * 11/1995 Hansen ..... A63B 69/3667 473/218
5,492,328 A 2/1996 Lundquist
5,707,301 A 1/1998 Tollin
5,944,613 A 8/1999 Dubois
6,195,903 B1 * 3/2001 Inglehart ..... B25H 7/02 33/32.1
6,726,576 B1 4/2004 Froggatte
7,261,640 B1 * 8/2007 Baggott ..... A63B 69/3667 473/270
7,469,485 B1 * 12/2008 Perdue ..... B43L 7/10 33/454

(Continued)

FOREIGN PATENT DOCUMENTS

WO 1996016707 6/1996
WO 2004069347 8/2004
WO 2005105225 11/2005

*Primary Examiner* — Nini F Legesse
(74) *Attorney, Agent, or Firm* — Benjamin C. Rothermel, Esq.

(57) ABSTRACT

An alignment rod includes a first rod and a second rod movably connected to each other, and a first connecting rod and a second connecting rod connecting the first rod and the second rod. The first rod and the second rod substantially overlap each other in a collapsed configuration, and the first rod and the second rod are spaced apart from each other in an expanded configuration.

17 Claims, 23 Drawing Sheets

(56) References Cited

U.S. PATENT DOCUMENTS

| | | | | |
|---|---|---|---|---|
| 7,775,900 | B1 * | 8/2010 | Karpyak | A63B 69/3667 473/272 |
| 7,922,598 | B1 | 4/2011 | Karpyak et al. | |
| 8,834,287 | B1 | 9/2014 | Reid | |
| 8,881,416 | B2 * | 11/2014 | Menendez | B05C 21/005 33/454 |
| 8,951,140 | B1 | 2/2015 | Kim | |
| 9,089,759 | B1 | 7/2015 | Moschillo | |
| 9,289,671 | B2 | 3/2016 | Heddleston | |
| 9,636,564 | B1 | 5/2017 | Arnold | |
| 2012/0202613 | A1 * | 8/2012 | Finch | A63B 69/3676 473/257 |
| 2018/0008877 | A1 | 1/2018 | Haycock | |

* cited by examiner

GOLF ALIGNMENT ROD

CROSS-REFERENCE TO RELATED APPLICATION

This application claims priority from and the benefit of U.S. Provisional Patent Appl. No. 63/026,183, filed on May 18, 2020, which is hereby incorporated by reference for all purposes as if fully set forth herein.

BACKGROUND

Field

Exemplary embodiments relate to an alignment rod used in the sport of golf.

Discussion of the Background

Accuracy and consistency are two important factors in golf. A player's golf swing may compensate for inconsistent and/or incorrect ball positioning, causing alterations in swing that produces poor contact with the ball. Player alignment and ball positioning are foundations of an accurate and consistent swing that may provide a more consistent round of golf.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a collapsible golf alignment rod configured to pop open using a spring-loaded push button, and having a parallel set of rods in an expanded configuration. The rods have connecting parts that expand or contract in distance.

Additional aspects will be set forth in the detailed description which follows, and, in part, will be apparent from the disclosure, or may be learned by practice of the inventive concept.

According to exemplary embodiments, an alignment rod includes a first rod and a second rod movably connected to each other, and a first connecting rod and a second connecting rod connecting the first rod and the second rod. The first rod and the second rod substantially overlap each other in a collapsed configuration, and the first rod and the second rod are spaced apart from each other in an expanded configuration.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
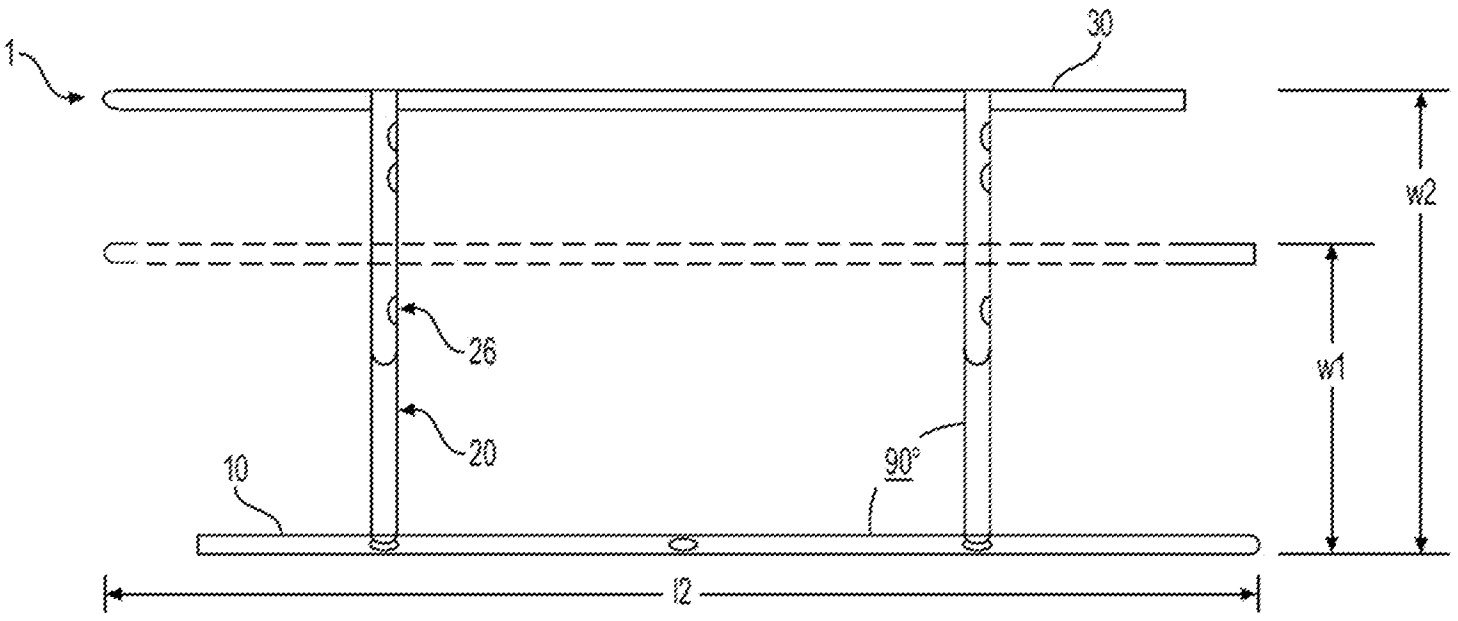
FIG. 1 shows a golf alignment rod according to an exemplary embodiment.
Figure 2:
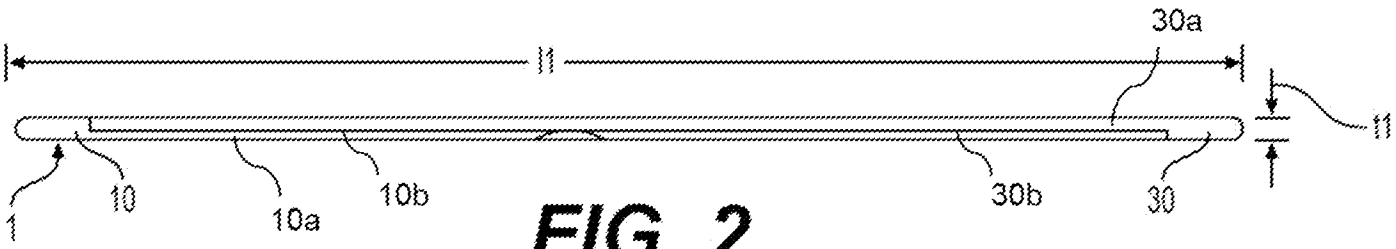
FIG. 2 is a side view of the golf alignment rod of FIG. 1.
Figure 3:
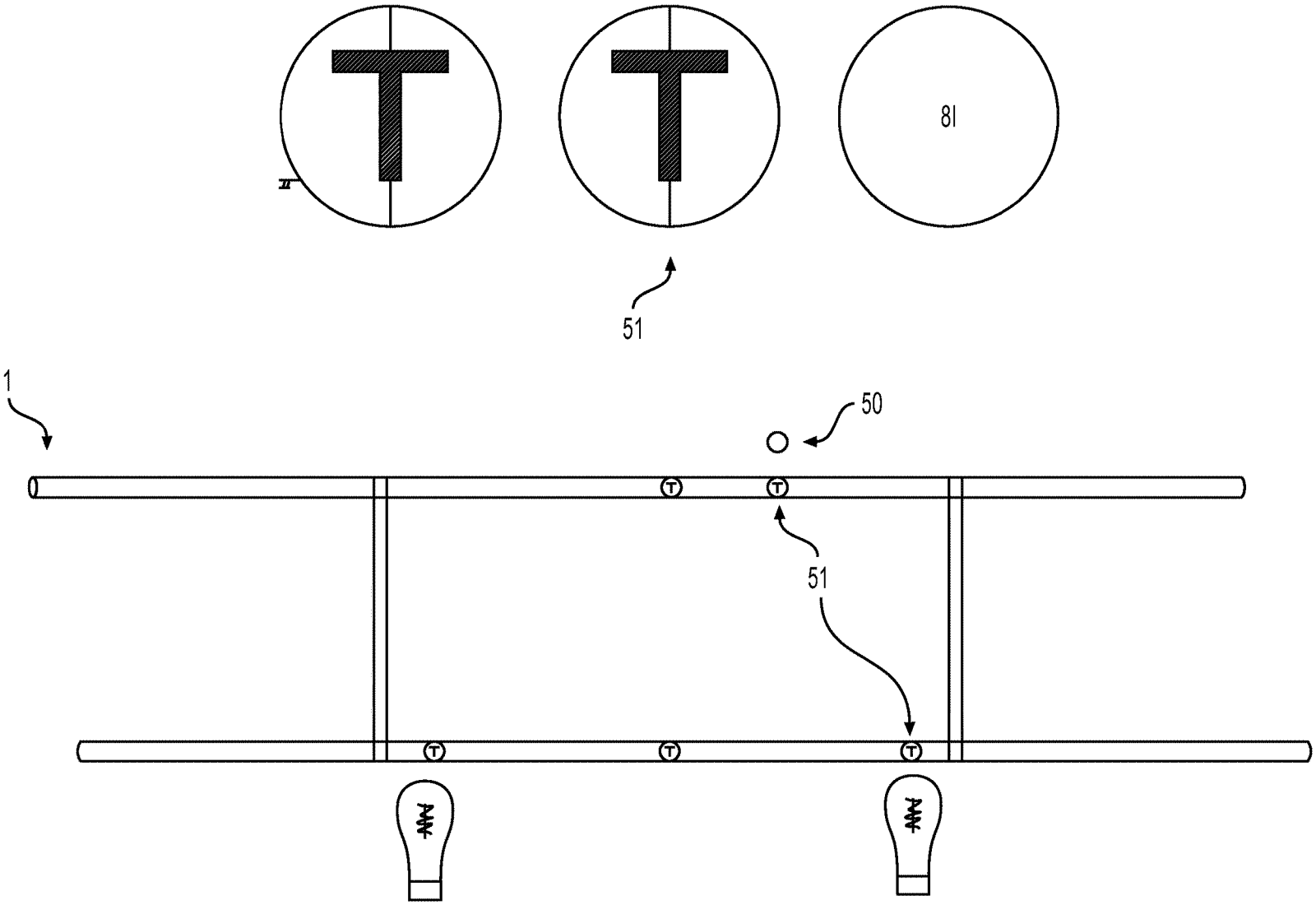
FIG. 3 and FIG. 4 show reference numbers and stickers of the golf alignment rod of FIG. 1.
Figure 4:
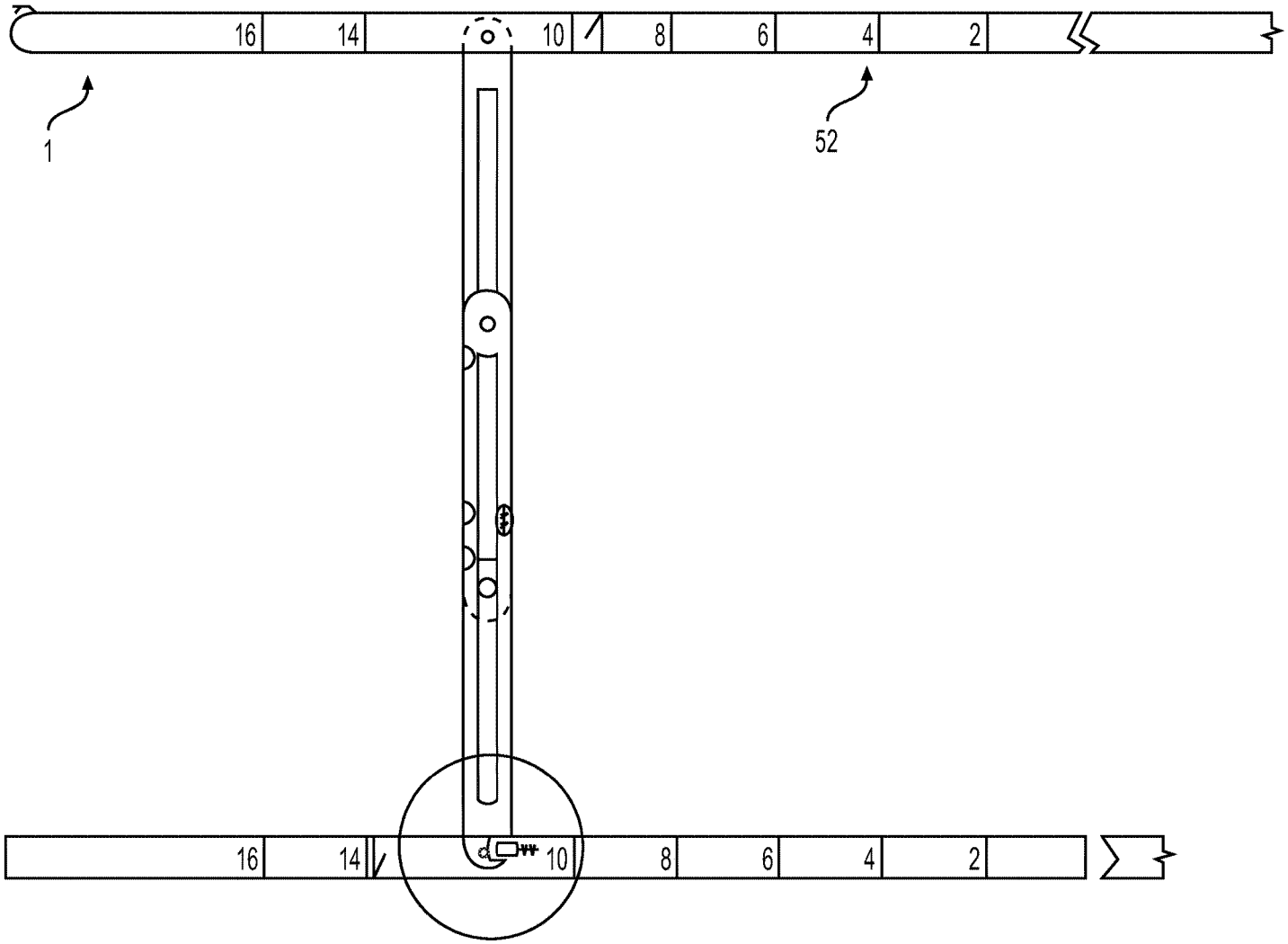
Figure 5:
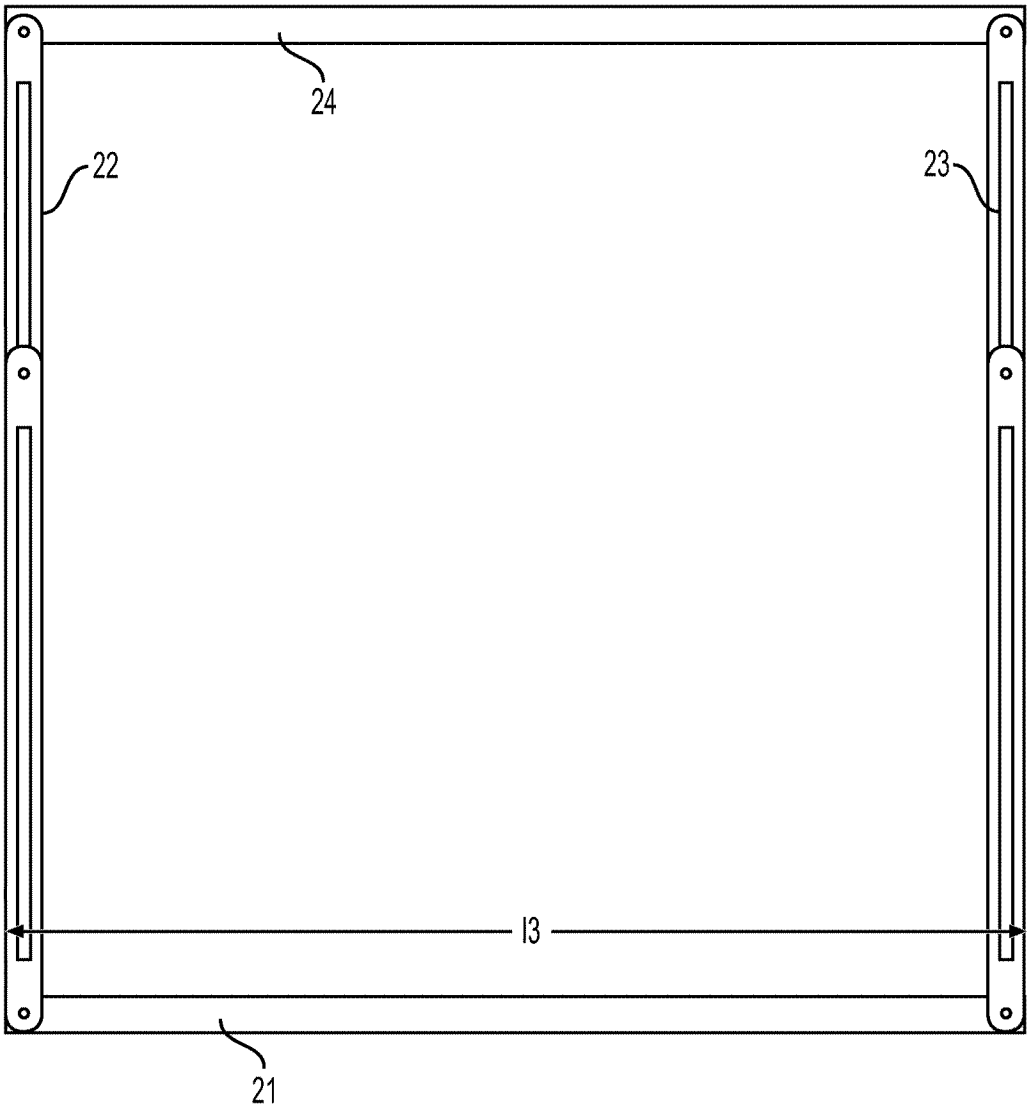
FIG. 5 shows a frame of the golf alignment rod of FIG. 1.
Figure 6:
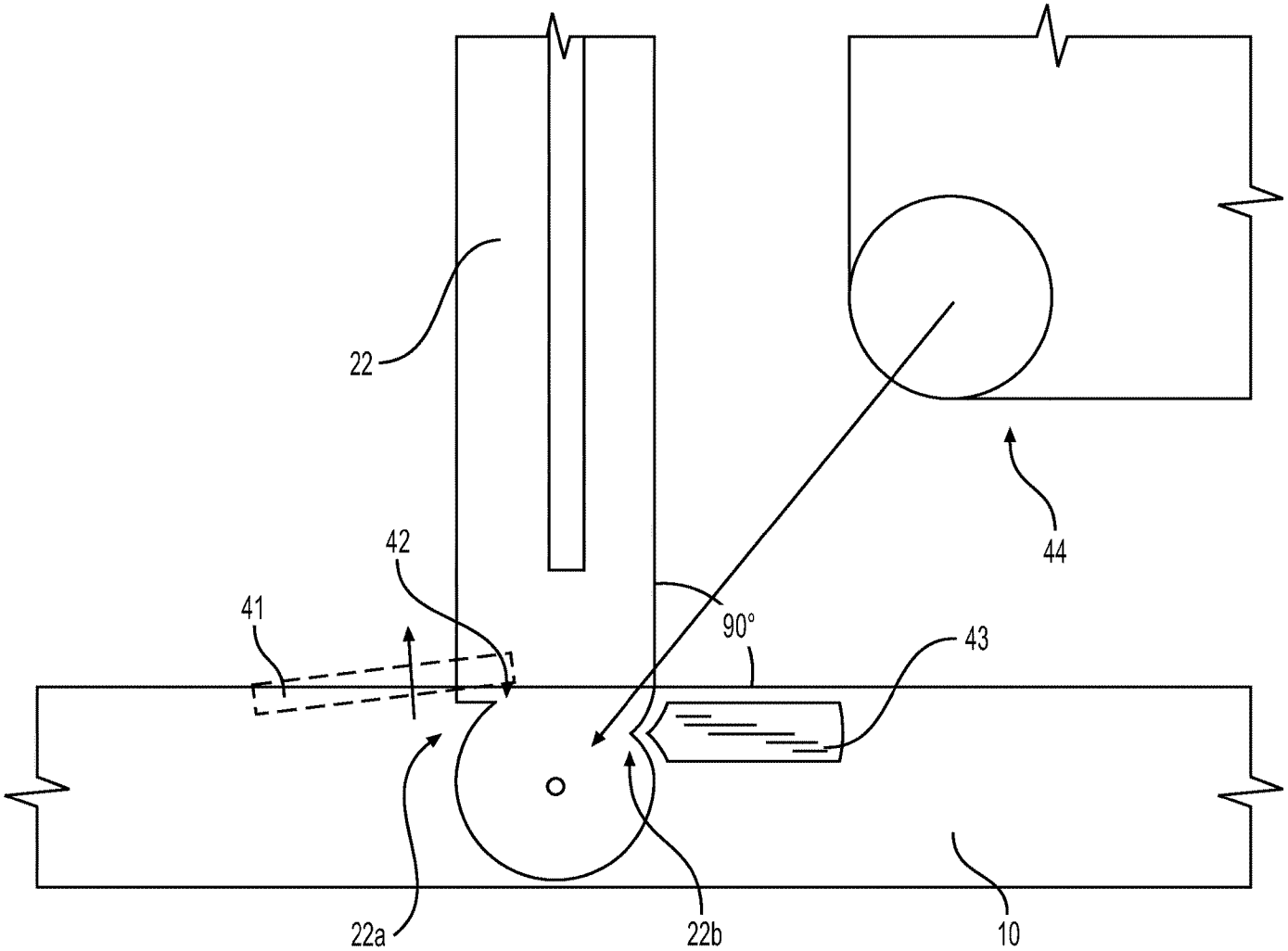
FIG. 6 shows a latch mechanism of the golf alignment rod of FIG. 1.
Figure 7:
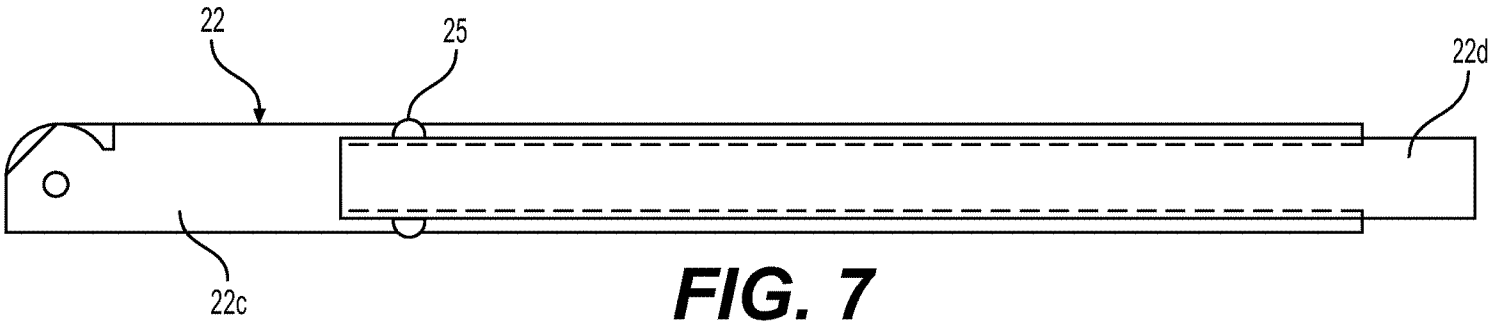
FIG. 7 shows a frame connecting part of the golf alignment rod of FIG. 1.
Figure 8A:
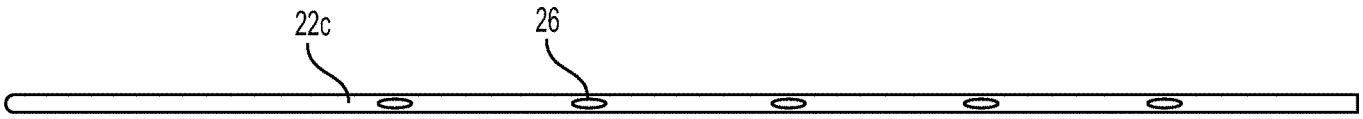
FIG. 8A is a side view of the frame connecting part of FIG. 7.
Figure 8C:
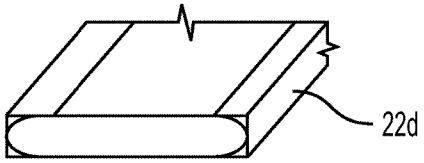
FIG. 8C is an end view of the tracked portion of the frame connecting part of FIG. 7.
Figure 8B:
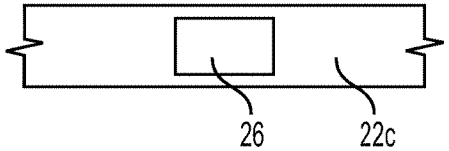
FIG. 8B is a close-up side view of a tracked portion of the frame connecting part of FIG. 7.
Figure 9:
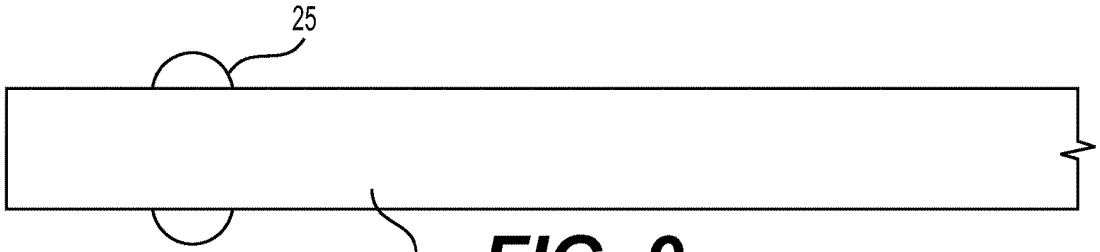
FIG. 9 shows a slidable portion of the frame connecting part of FIG. 7.
Figure 10:
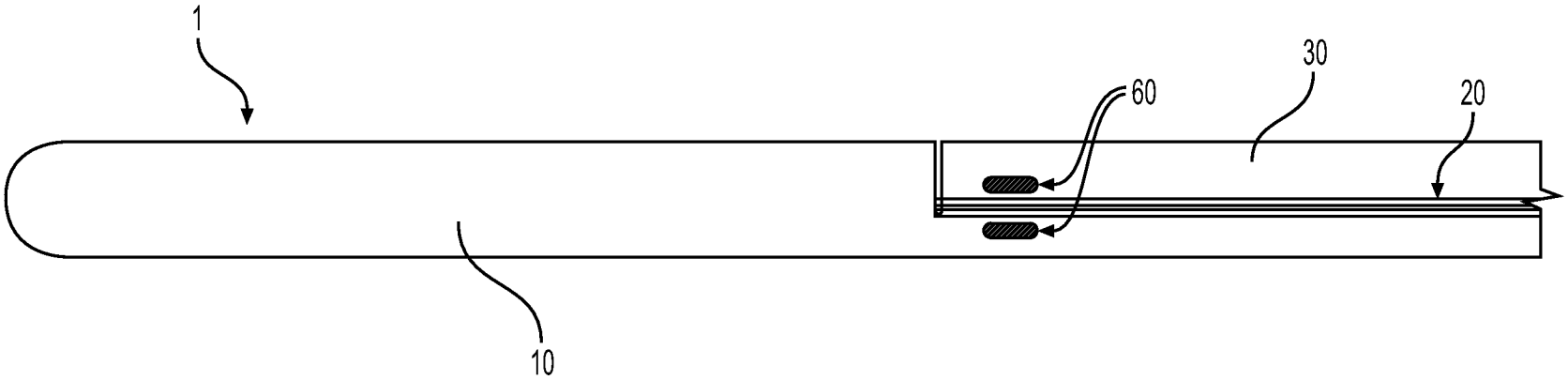
FIG. 10 shows a close-up side view of the golf alignment rod of FIG. 1.

The present disclosure is described more fully hereinafter with reference to the accompanying drawings, in which exemplary embodiments are shown. The present disclosure may, however, be embodied in many different forms and should not be construed as limited to the exemplary embodiments set forth herein. Rather, these exemplary embodiments are provided so that the present disclosure is thorough. In the following description, for the purposes of explanation, numerous specific details are set forth in order to provide a thorough understanding of various exemplary embodiments. It is apparent, however, that various exemplary embodiments may be practiced without these specific details or with one or more equivalent arrangements.

Exemplary embodiments relate to an alignment rod used in the sport of golf. The alignment rod sets up in seconds, and fits in a golf bag for easy access and transportation while in a collapsed configuration. According to an exemplary embodiment as shown in FIG. 1, FIG. 2, FIG. 3, FIG. 4, FIG. 5, FIG. 6, FIG. 7, FIG. 8A, FIG. 8B, FIG. 8C, FIG. 9, FIG. 10, and FIG. 18, the alignment rod 1 pops open, using a spring-loaded push button, to a parallel set of rods in an expanded configuration. The rods expand or contract in distance from each other, based on different lengths of golf clubs to be used. A shorter extension setting may be used for smaller irons or wedges, and a longer extension setting may be used for longer irons or a driver. The rods are lined with reference numbers 52 to help a user set up the same every time in relation to a golf ball 50, and may include stickers 51 attached to mark the alignment rod for every club selection and stance position.

The alignment rod 1 may be used by a right- or left-handed person, because it is symmetrically configured. It may be used for a wide range of user heights, due to the extendable rods. The alignment rod 1 can be personalized depending on the physical characteristics and needs of each particular user. Everyone's golf stance and swing are different, so the alignment rod 1 enables more effective golf practice based on the personalized nature.

To use the alignment rod 1, such as when practicing on a golf course, a user finds the distance needed and selects the appropriate golf club. Then, the alignment rod 1 is placed on the ground in the expanded configuration, and a user aligns her feet with the alignment rod 1. Depending on the selected club, a user may align his feet and the golf ball in different places along the alignment rod 1. Thus, the stickers 51 may be used to mark each foot and ball placement on the alignment rod 1, which correspond to a particular club. Once a user has marked a desired club setting on the alignment rod, relying on pre-selected sticker 51 settings makes lining up in a repeatable stance extremely easy and quick.

The alignment rod 1 has a thickness t1 and a length l1 in the collapsed configuration. According to the present exemplary embodiment, thickness t1 is ¾ inch and length l1 is 4 feet (48 inches). The alignment rod 1 is designed to fit in a golf bag, for easy access and transportability, when in a collapsed configuration. The alignment rod 1 has a bottom rod 10 and a top rod 30 with a frame 20 attached therebetween. In the collapsed configuration, the bottom rod 10, frame 20, and top rod 30 substantially overlap. The alignment rod 1 is round and made of fiberglass, so in the collapsed configuration has a similar appearance as a golf club. That is, the bottom rod 10 has a bottom half 10*a* that is rounded, and a top half 10*b* that is substantially flat. The frame 20 is connected to the top surface of the bottom rod 10. The top rod 30 has a top half 30*a* that is rounded, and a bottom half 10*b* that is substantially flat. The frame 20 is connected to the bottom surface of the top rod 30.

The frame 20 expands relative to the collapsed configuration of the alignment rod 1, causing the top rod 30 to separate from the bottom rod 10, to place the alignment rod 1 in an expanded configuration, as described in detail below. The frame 20 has a first frame part 21 that extends along and is connected to the bottom rod 10, and a second frame part 24 that extends along and is connected to the top rod 30. The bottom rod 10 and the top rod 30 have a length l2. According to the present exemplary embodiment, length l2 is 42 inches. The first frame part 21 and second frame part 24 are each a substantially flat metal bracket having a length l3. According to the present exemplary embodiment, length l3 is 18 inches. First ends of the first frame connecting part 22 and the second frame connecting part 23 are connected to each end of the first frame part 21. Second ends of the first frame connecting part 22 and the second frame connecting part 23 are connected to each end of the second frame part 24.

The frame 20 has a square shape when expanded, with the first frame part 21 and the second frame part 24 being substantially parallel to each other, and the first frame connecting part 22 and the second frame connecting part 23 being substantially parallel to each other. The first frame part 21 and second frame part 24 are each substantially perpendicular to the first frame connecting part 22 and the second frame connecting part 23 in the expanded configuration. The first frame connecting part 22 and the second frame connecting part 23 each respectively lock in place at 90° when expanded from the bottom rod 10. The square shape of the frame increases the structural stability of the alignment rod 1.

When the first frame connecting part 22 is expanded, it locks in place at 90° with respect to the bottom rod 10, the first frame part 21, and the second frame part 24. The first frame connecting part 22 is initially locked in the collapsed configuration by a latch 41. Magnets 60 are also set in each of the bottom rod 10 and the top rod 30, which overlap and hold the alignment rod 1 in the collapsed configuration. The latch 41 has a catch 42 at one end, and the first frame connecting part 22 has a receiving portion 22*a* for the catch 42. The first frame connecting part 22 has a circular end that is rotatably connected to the first frame part 21 and the bottom rod 10. When the latch 41 is released by pushing one end thereof, the catch 42 at the other end is withdrawn from the receiving portion 22*a*.

The circular end of the first frame connecting part 22 has a coil spring 44 that is compressed and creates tension when the first frame connecting part 22 is not extended, that is, when the alignment rod 1 is in the collapsed configuration. Thus, when the latch 41 is released and the catch 42 is withdrawn from the receiving portion 22*a*, the tension from the coil spring 44 is released, and the first frame connecting part 22 can be rotated 90° to the extended position. A locking pin 43 connected to the first frame part 21 extends into a locking portion 22*b* of the first frame connecting part 22. The locking pin 43 has a spring tension, and releasably locks the first frame connecting part 22 in the extended position. Likewise, a second end of the first frame connecting part 22 is rotatably connected to the top rod 30 and the second frame part 24. A locking pin connected to the second frame part 24 extends into a locking portion of the first frame connecting part 22 to releasably lock the first frame connecting part 22 in the extended position.

The second frame connecting part 23 is configured substantially similarly as the first frame connecting part 22, as described above, and repeated description is omitted herein. A first end of the second frame connecting part 23 is rotatably connected to the bottom rod 10 and the first frame part 21, and a second end of the second frame connecting part 23 is rotatably connected to the top rod 30 and the second frame part 24.

The first frame connecting part 22 and the second frame connecting part 23 are extendable. Accordingly, the alignment rod 1 has a minimum opening width w1 and a maximum opening width w2, when the frame 20 is expanded and the alignment rod 1 is in an expanded configuration. As shown in FIG. 7, FIG. 8A, FIG. 8B, FIG. 8C, and FIG. 9, the first frame connecting part 22 has a slidable portion 22*c* with spring-loaded stop latches 25, and the slidable portion 22*d* is inset in a tracked portion 22*c*. The tracked portion 22*c* has latch holes 26 in the sides thereof, corresponding to the minimum opening width w1 and the maximum opening width w2. The second frame connecting part 23 has a substantially equivalent configuration as shown and described with respect to the first frame connecting part 22.

Further, the tracked portions have draw and/or fade latch holes, which are set between the minimum opening width w1 and the maximum opening width w2 latch holes. The draw/fade latch holes may be used to implement an alignment for hitting draw or fade shots. Specifically, one of the first frame connecting part 22 or the second frame connecting part 23 is extended further than the other when the draw/face latch hole is used. Thus, the top rod 30 is offset from being parallel with the bottom rod 10 in this configuration.

An alignment rod 100 according to an exemplary embodiment is shown in FIG. 11, FIG. 12, FIG. 13, FIG. 14, FIG. 15, FIG. 16, and FIG. 17. The alignment rod 100 according to the present exemplary embodiment may be substantially similar in various respects to the alignment rod 1 as described with respect to FIG. 1, FIG. 2, FIG. 3, FIG. 4, FIG. 5, FIG. 6, FIG. 7, FIG. 8A, FIG. 8B, FIG. 8C, FIG. 9, FIG. 10, and FIG. 18 of the present application, and the disclosure thereof is incorporated herein by reference, and any repeated disclosure may be omitted for the sake of brevity. Likewise, the disclosure with respect to the alignment rod 100 described in connection with FIG. 11, FIG. 12, FIG. 13, FIG. 14, FIG. 15, FIG. 16, and FIG. 17 is incorporated by reference into the exemplary embodiment described with respect to FIG. 1, FIG. 2, FIG. 3, FIG. 4, FIG. 5, FIG. 6, FIG. 7, FIG. 8A, FIG. 8B, FIG. 8C, FIG. 9, FIG. 10, and FIG. 18.

Figure 11:
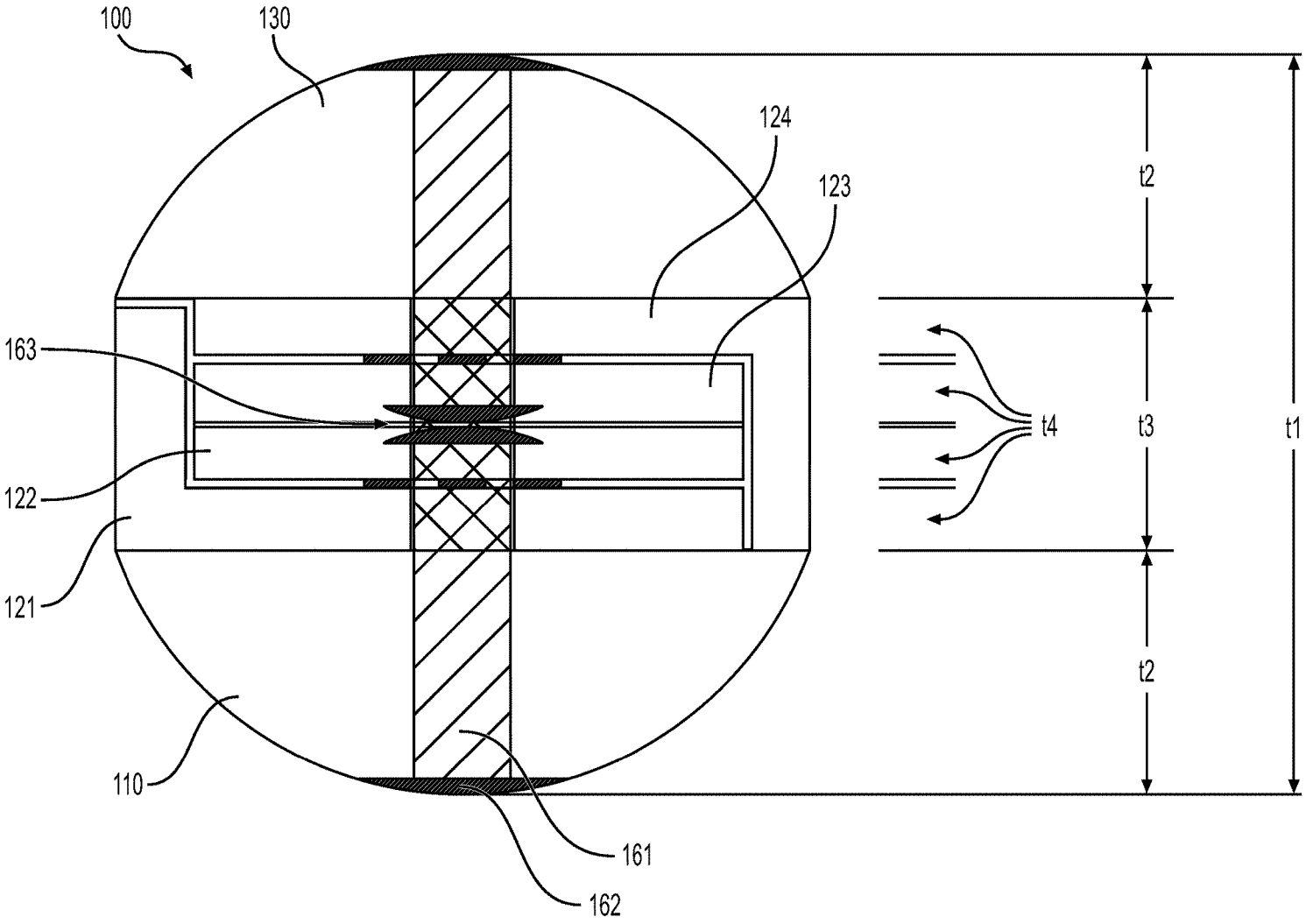
FIG. 11 shows a cross-sectional view of a golf alignment rod according to an exemplary embodiment.
Figure 12:
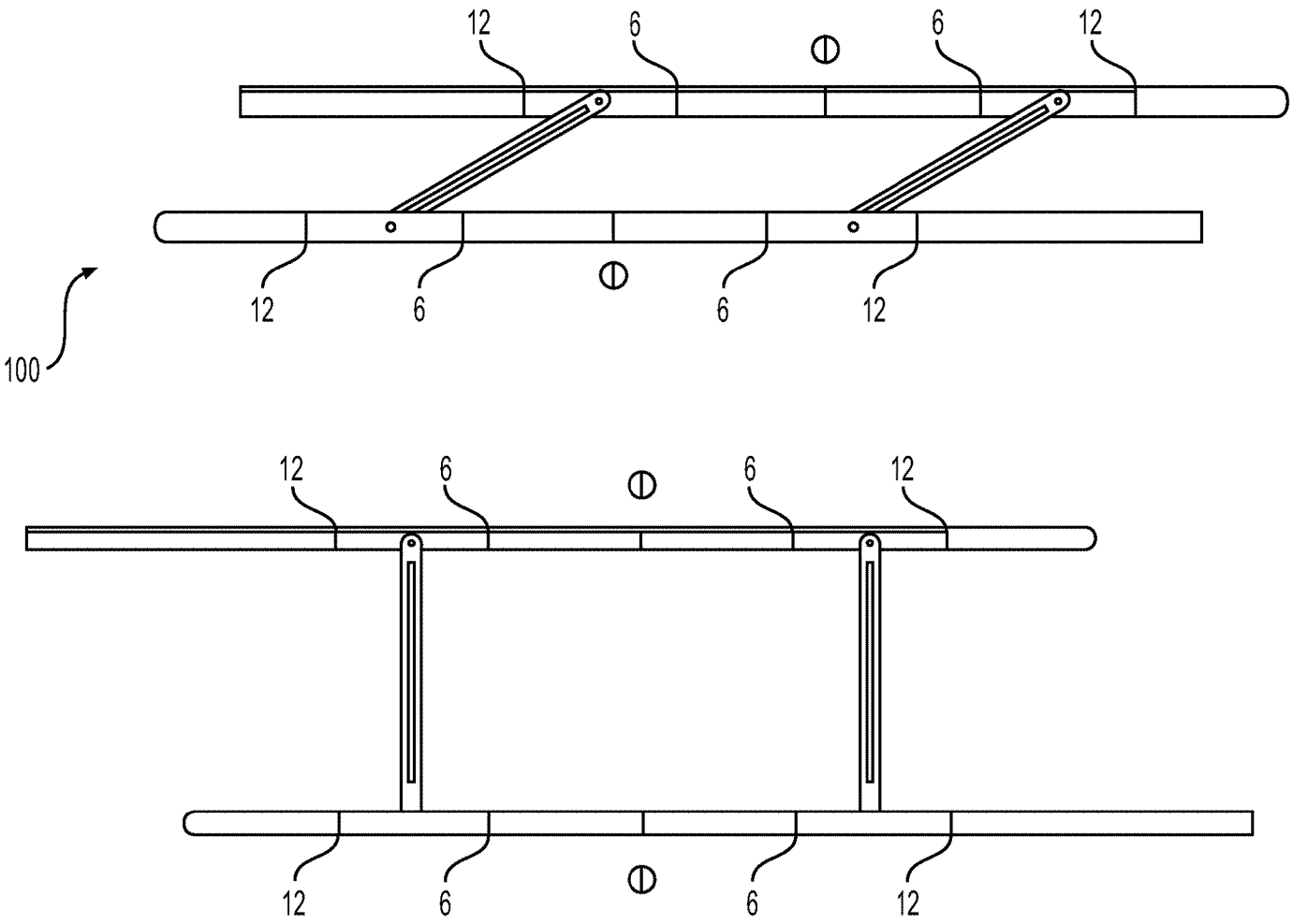
FIG. 12 and FIG. 13 show the golf alignment rod of FIG. 11.
Figure 13:
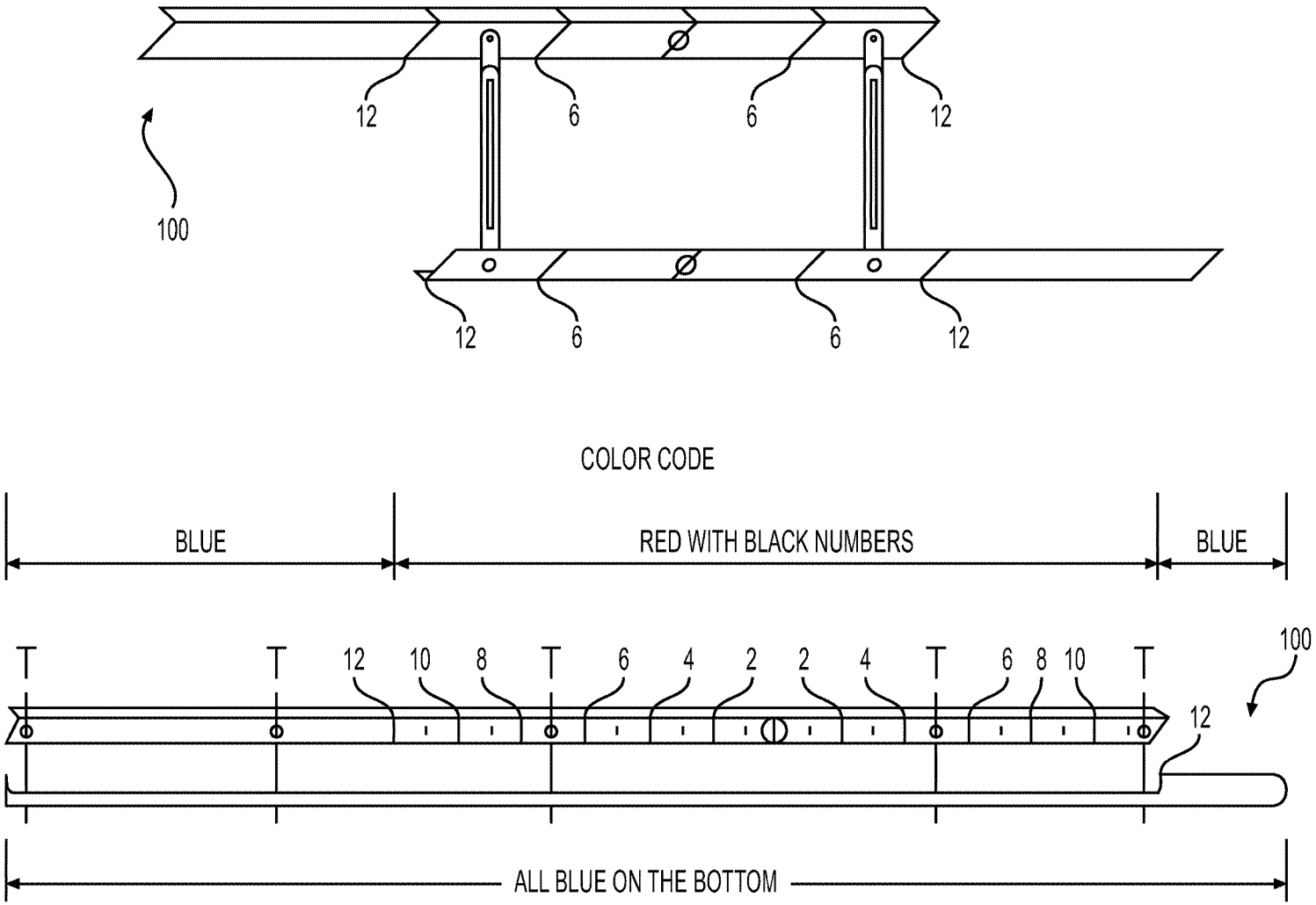

As shown in FIG. 11, the alignment rod 100 has a thickness t1 in a collapsed configuration, as described above. According to the present exemplary embodiment, thickness t1 is 1 inch. The alignment rod 100 has a bottom rod 110 and a top rod 130 with a frame 120 attached therebetween. The bottom rod 110 and top rod 130 have a thickness t2, which according to the present exemplary embodiment is 5/16 of an inch. The thickness t3 of the frame 120, according to the present exemplary embodiment is 3/8 of an inch.

The frame 120 has a first frame part 121 that is connected to the bottom rod 110, and a second frame part 124 that extends along and is connected to the top rod 130. The first frame part 121, first frame connecting part 122, second frame connecting part 123, and second frame part 124 are each a substantially flat metal bracket having a thickness t4. According to the present exemplary embodiment, t4 is 1/16 of an inch. According to the present exemplary embodiment, the first frame part 121 and second frame part 124 each have side brackets that extend between the bottom rod 110 and the top rod 130, and cover the sides of the frame 120.

Figure 14:
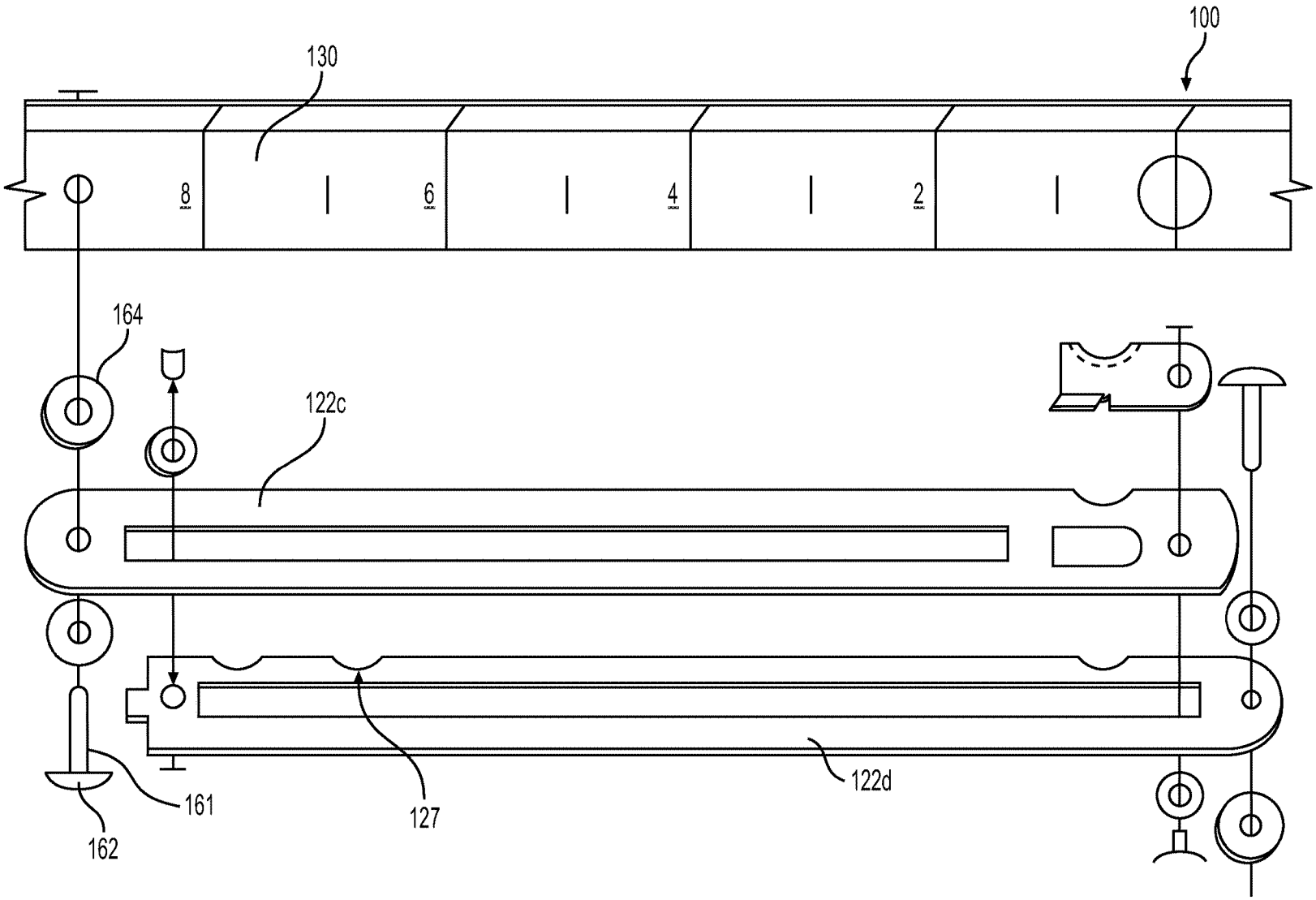
FIG. 14 shows an exploded view of the golf alignment rod of FIG. 11.

Pins 161 with heads 162 and 163 rotatably connect the frame 120, the bottom rod 110 and the top rod 130. Washers 164 may be interspersed between rotating parts of the alignment rod 100. As shown in FIG. 14, the first frame connecting part 122 has a slidable portion 122*c* with spring-loaded stop latches, and the slidable portion 122*c* is connected to tracked portion 122*d*. The tracked portion 122*d* has latch holes 127 in the outer sides thereof. The latch holes 127 allow the slidable portion 122*c* to be retained in a desired configuration (that is, collapsed or extended) within the tracked portion 122*d* via the stop latches, which can be easily released. The second frame connecting part 123 has a substantially equivalent configuration as shown and described with respect to the first frame connecting part 122.

Figure 15:
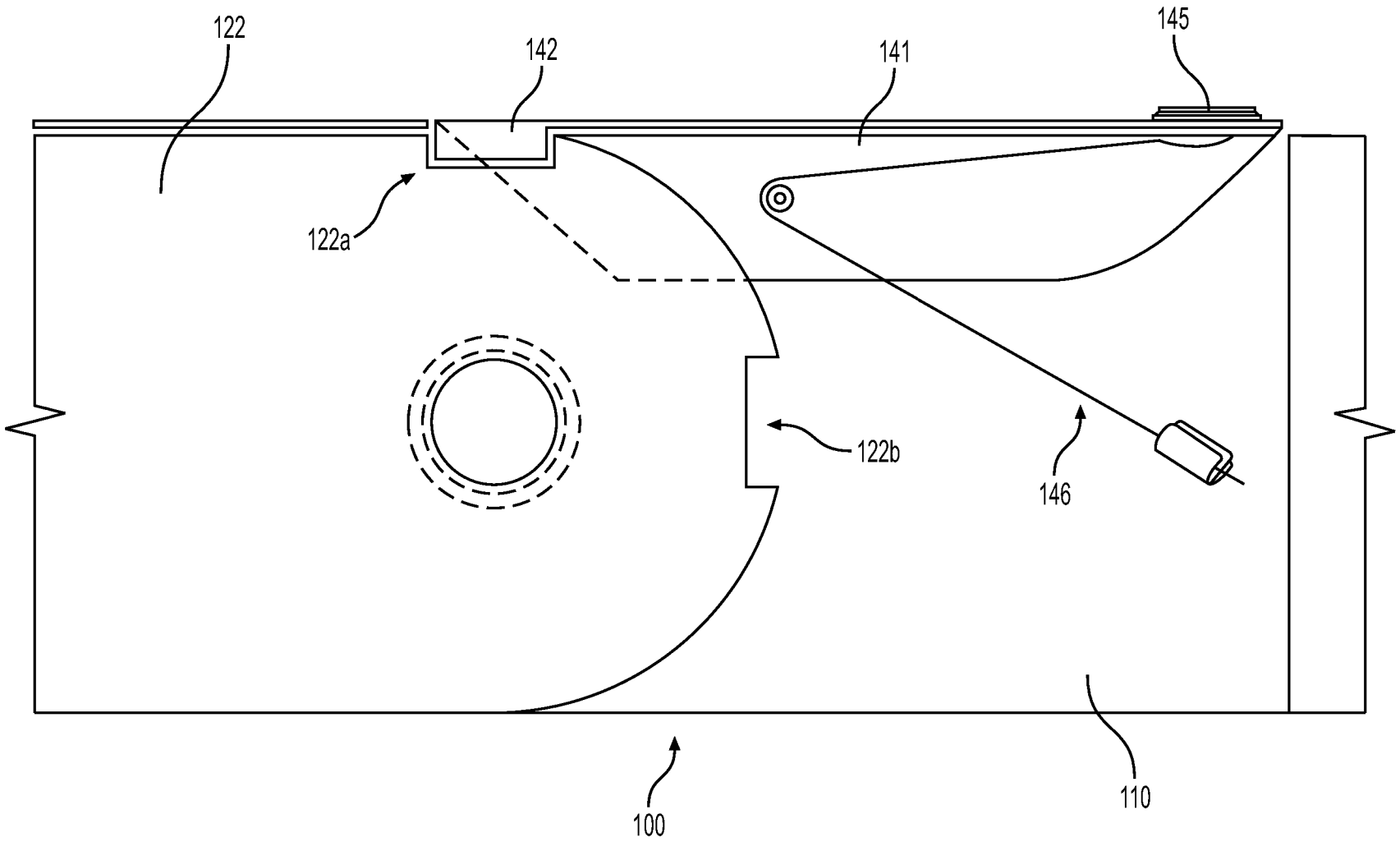
FIG. 15 and FIG. 16 show a latch of the golf alignment rod of FIG. 11.
Figure 16:
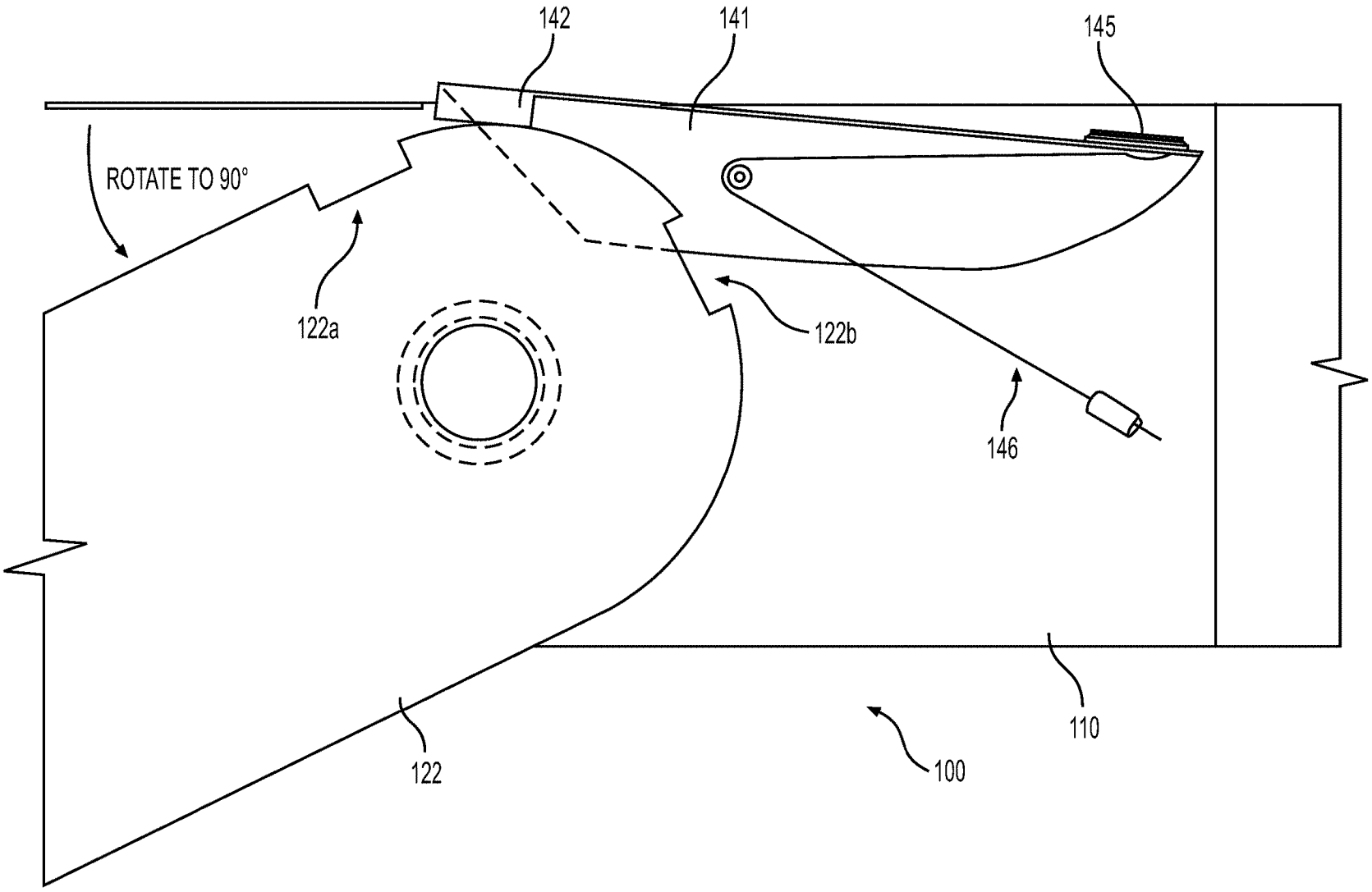
Figure 17:
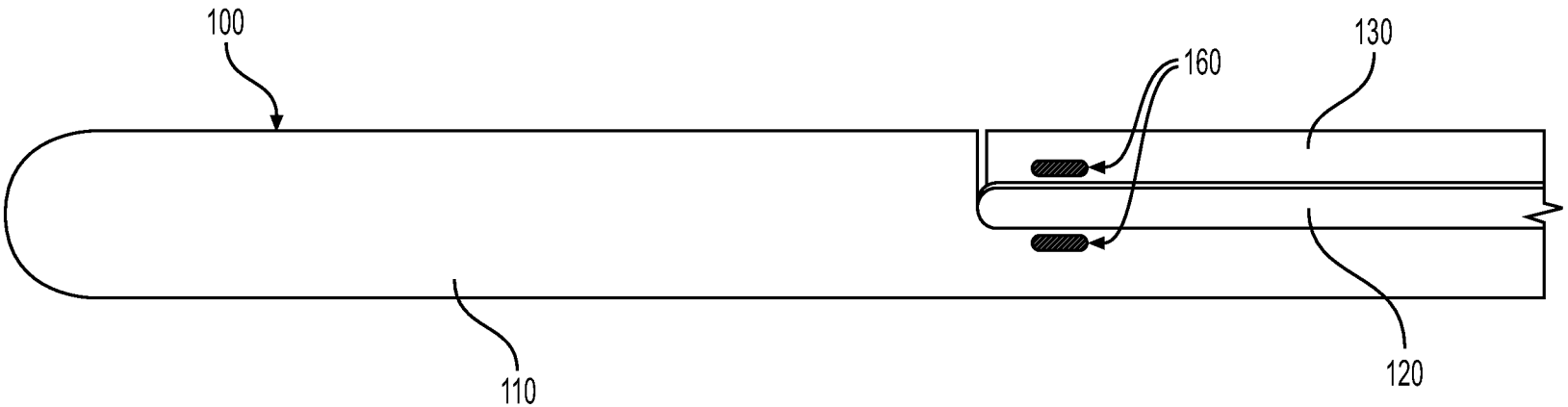
FIG. 17 shows a close-up side view of the golf alignment rod of FIG. 11.
Figure 18:
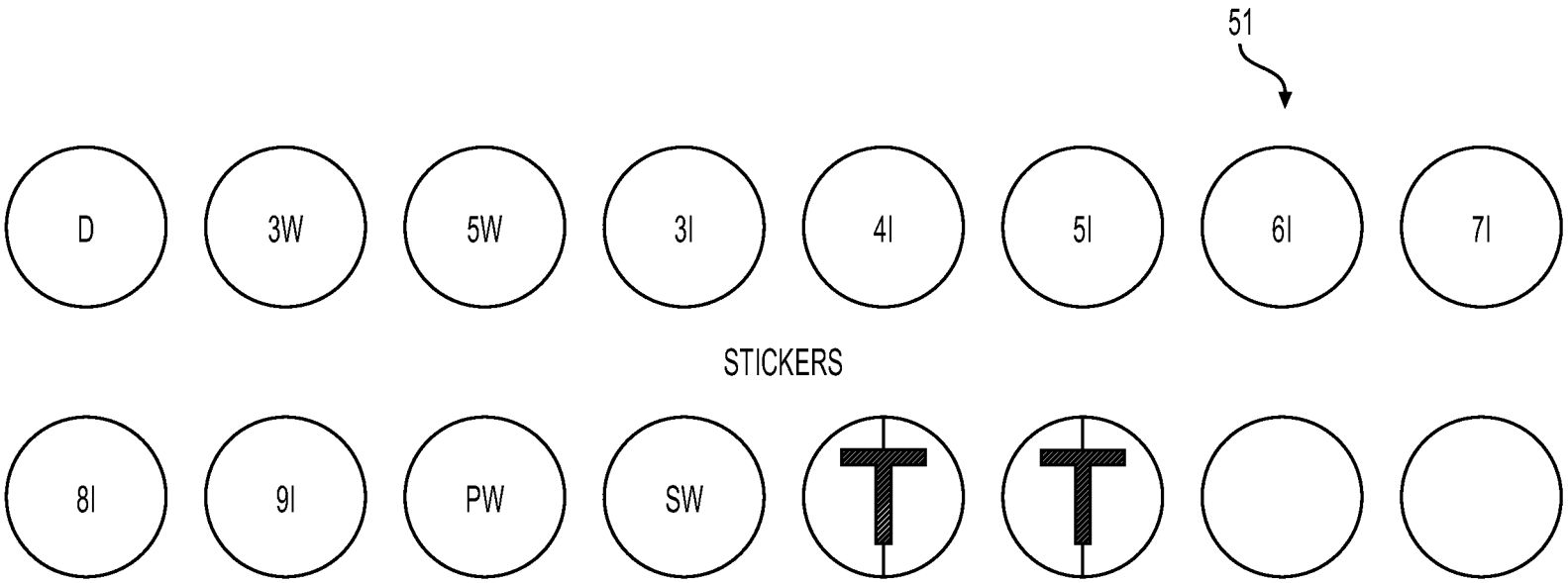
FIG. 18 shows stickers for use with the golf alignment rod of FIG. 1 or FIG. 11.

As shown in FIG. 15 and FIG. 16, when the first frame connecting part 122 is expanded, it locks in place at 90° with respect to the bottom rod 110. The first frame connecting part 122 is initially locked in the collapsed configuration by a latch 141. The latch 141 has a catch 142 at one end, and the first frame connecting part 122 has a receiving portion 122*a* for the catch 142. The first frame connecting part 122 has a circular end that is rotatably connected to the bottom rod 110. When the latch 141 is released by pushing a release button 145 located at one end thereof, the catch 142 at the other end is withdrawn from the receiving portion 122*a*. The latch 141 is spring-loaded via a tension spring 146 attached to the bottom rod 110.

Thus, when the latch 141 is released and the catch 142 is withdrawn from the receiving portion 122*a*, the first frame connecting part 122 can be rotated 90° to the extended position. The catch 142 of the latch 141 extends into a locking portion 122*b* of the first frame connecting part 122. Since the latch 141 has a tension spring 146, the catch 142 releasably locks the first frame connecting part 122 in the extended position.

An alignment rod 200 according to an exemplary embodiment is shown in FIG. 19, FIG. 20A, FIG. 20B, FIG. 21A, FIG. 21B, FIG. 22, FIG. 23A, FIG. 23B, FIG. 24, and FIG. 25. The alignment rod 200 according to the present exemplary embodiment may be substantially similar in various respects to the alignment rod 1 and the alignment rod 100 as described above, and the disclosure thereof is incorporated herein by reference, and any repeated disclosure may be omitted for the sake of brevity. Likewise, the disclosure with respect to the alignment rod 200 described herein is incorporated by reference into the exemplary embodiments described with respect to FIG. 1 through FIG. 18.

Figure 19:
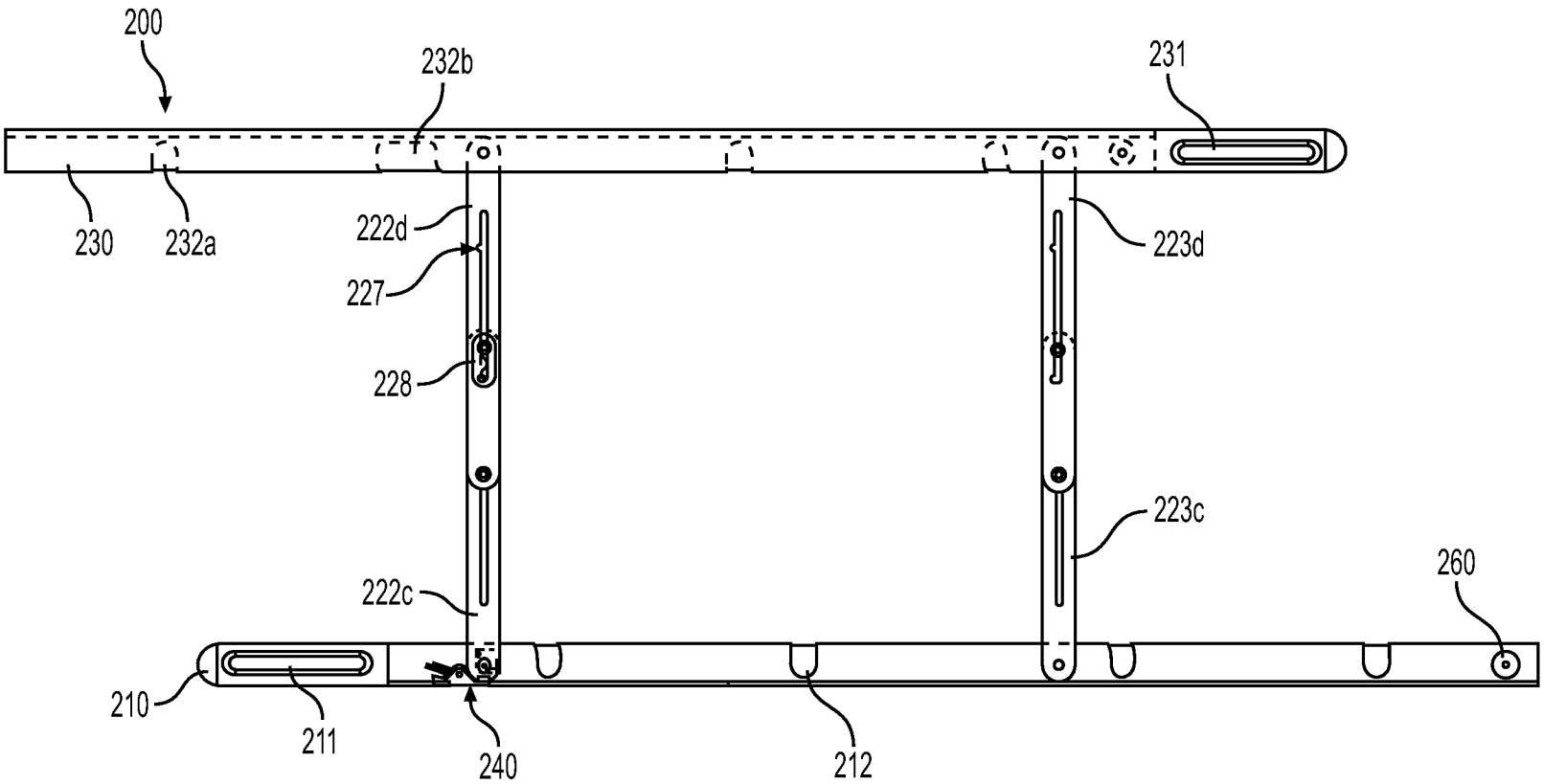
FIG. 19 shows a golf alignment rod according to an exemplary embodiment.
Figure 20A:
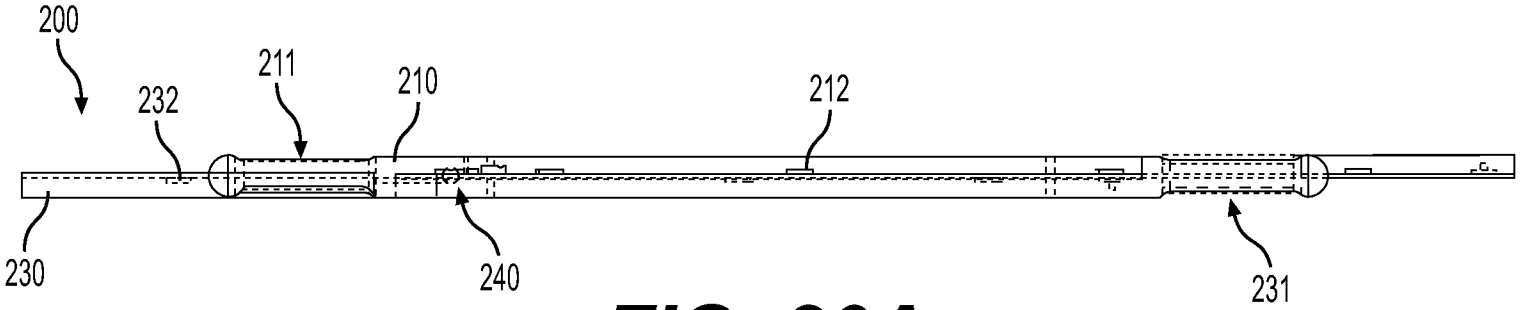
FIG. 20A and FIG. 20B show front and rear views of the golf alignment rod of FIG. 19, respectively.
Figure 20B:
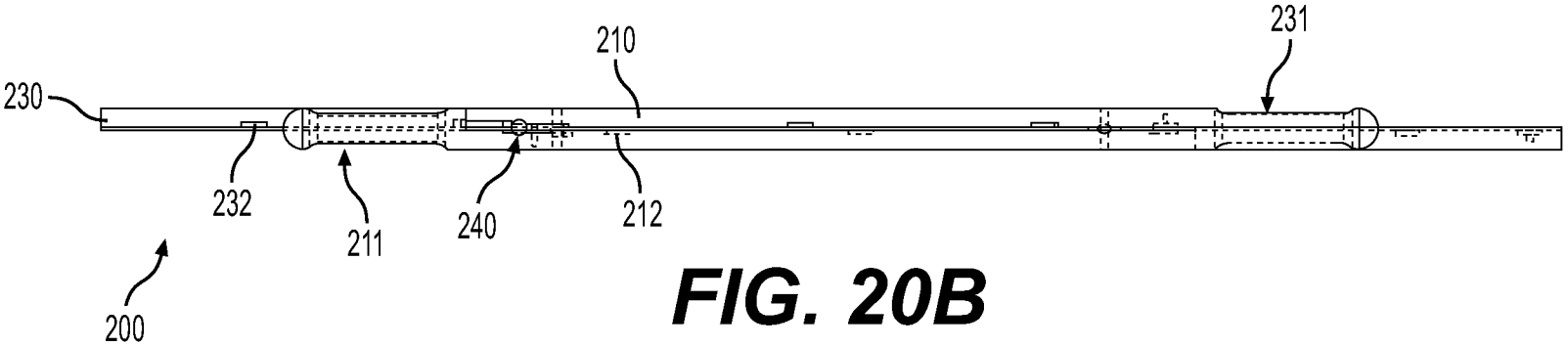
Figure 21A:
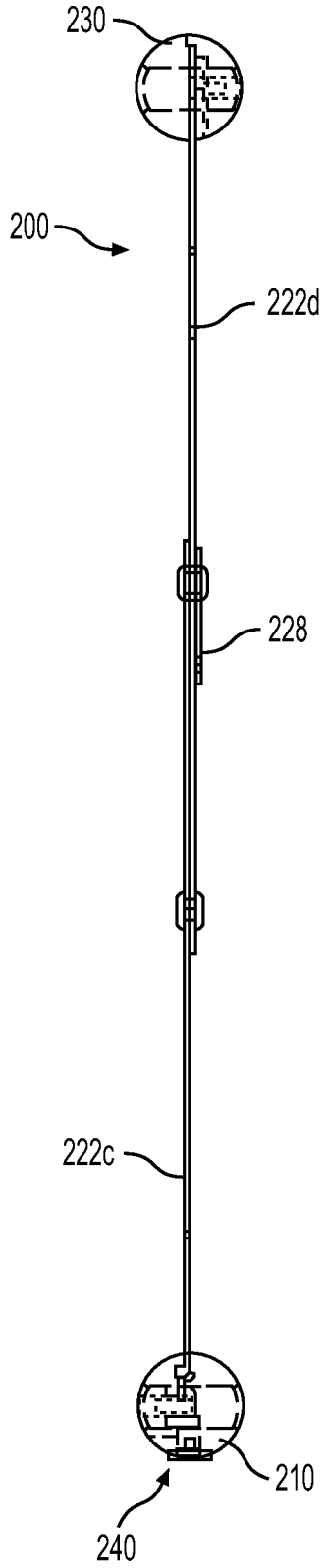
FIG. 21A and FIG. 21B show side views of the golf alignment rod of FIG. 19.
Figure 21B:
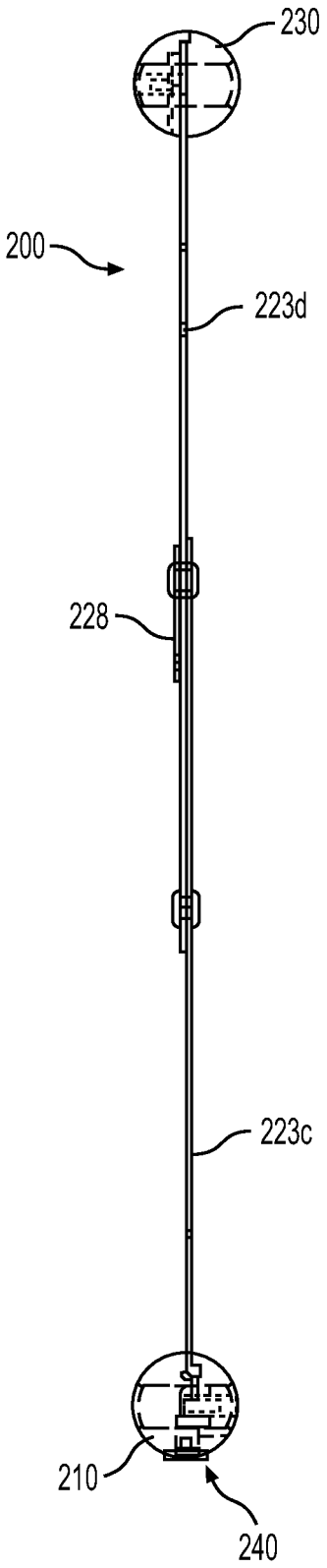
Figure 24:
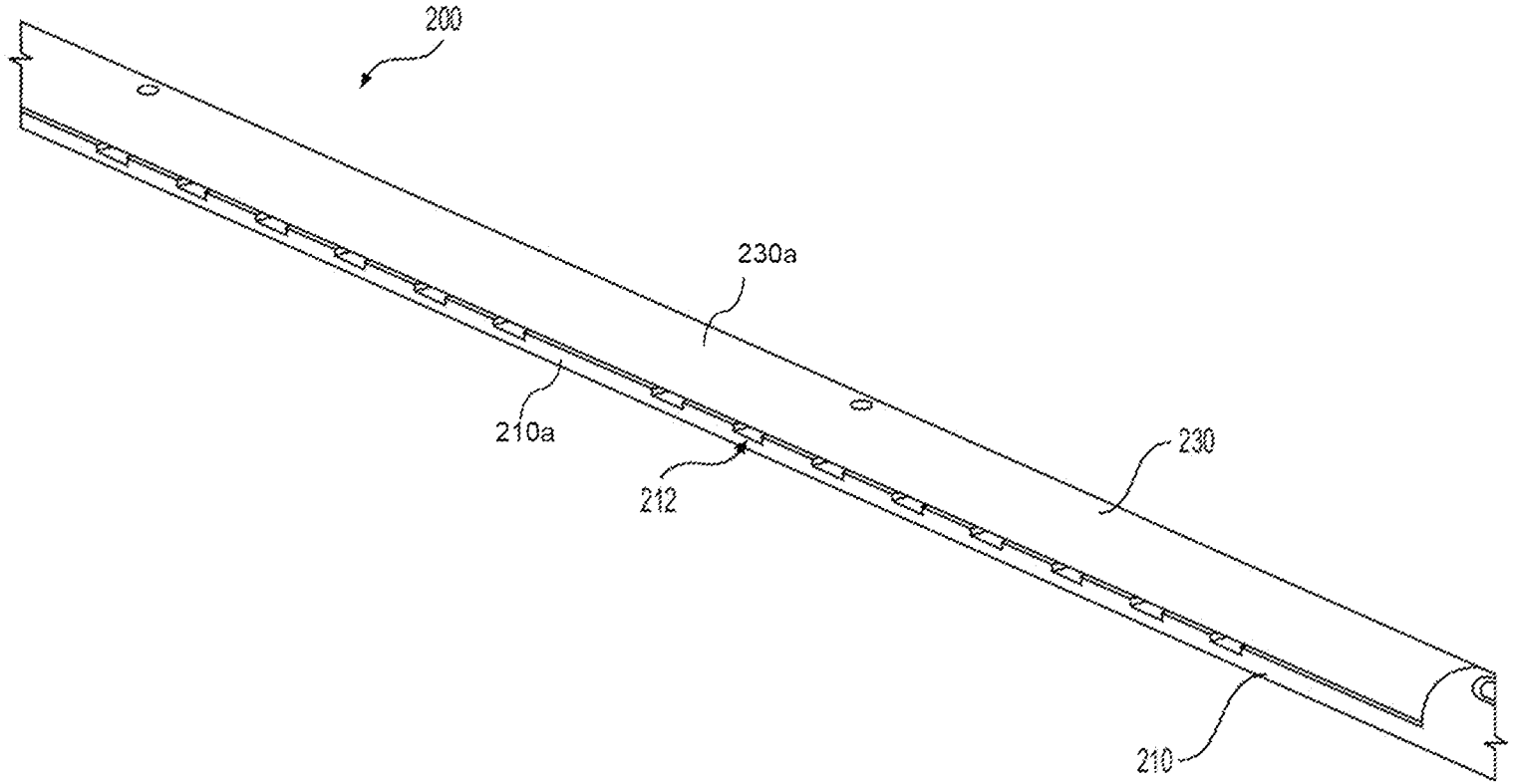
FIG. 24 shows a perspective view of the golf alignment rod of FIG. 19 in a collapsed configuration.
Figure 25:
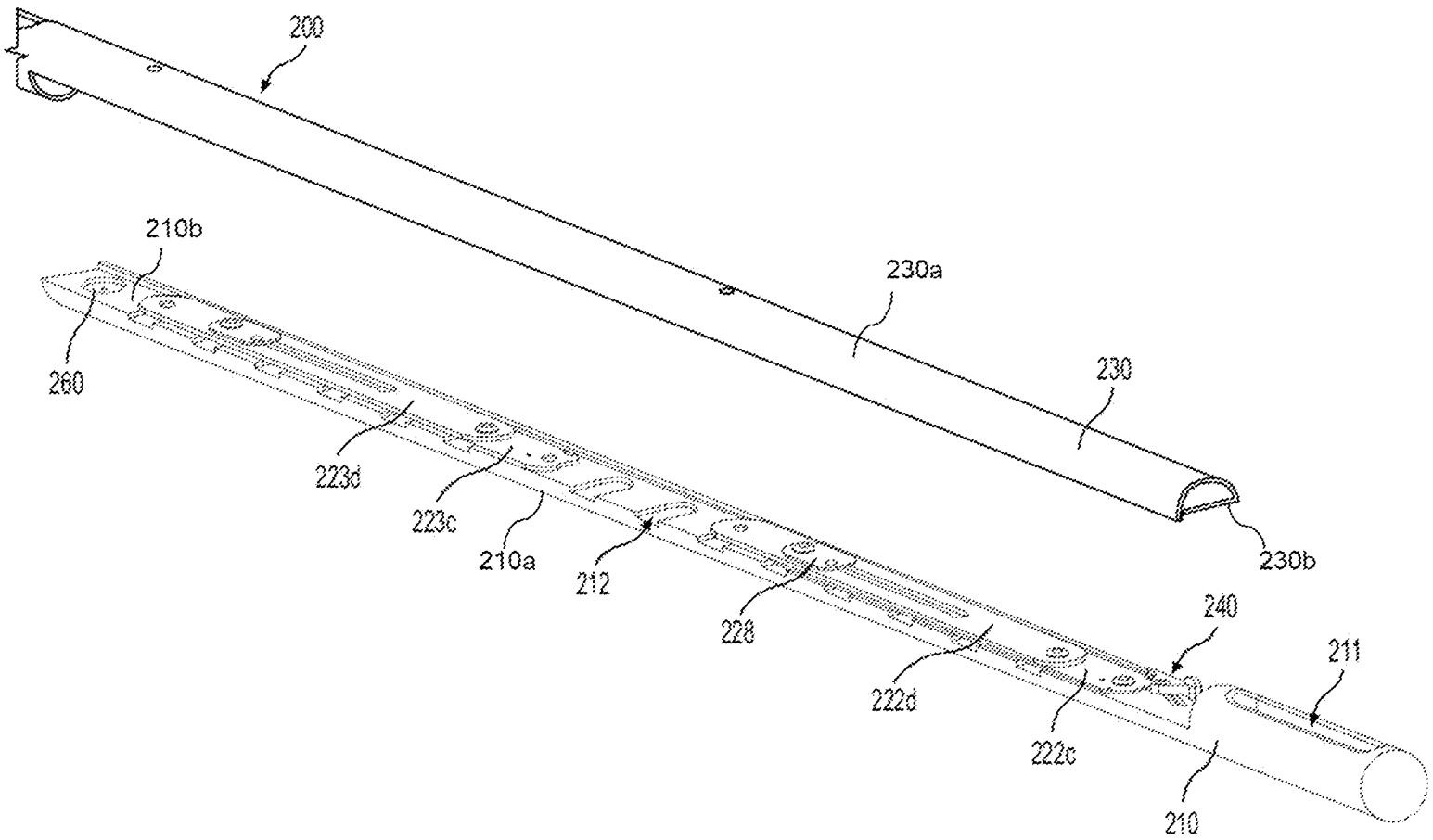
FIG. 25 shows an exploded perspective view of the golf alignment rod of FIG. 19 in a collapsed configuration.

The alignment rod 200 has a bottom rod 210 and a top rod 230 with a first connecting part 222 and a second connecting part 223 attached therebetween, as shown in FIG. 19. Each of the first connecting part 222 and the second connecting part 223 has two connected elements "c" and "d", described in detail below, which may herein be generally referred to together as the first connecting part 222 or the second connecting part 223. In a collapsed configuration, the bottom rod 210, the first connecting part 222, the second connecting part 223, and the top rod 230 substantially overlap, as shown in FIG. 24. The alignment rod 200 is round and made of fiberglass, so in the collapsed configuration has a similar appearance as a golf club. That is, as shown in FIG. 24 and FIG. 25, the bottom rod 210 has a bottom half 210*a* that is rounded, and a top half 210*b* that is substantially flat. The top rod 230 has a top half 230*a* that is rounded, and a bottom half 230*b* that is substantially flat. The first connecting part 222 and second connecting part 223 are respectively connected to the top surface of the bottom rod 210. The first connecting part 222 and second connecting part 223 are respectively connected to the bottom surface of the top rod 230.

When the alignment rod 200 is in an expanded configuration, the bottom rod 210 and the top rod 230 are substantially parallel to each other, and the first connecting part 222 and the second connecting part 223 are substantially parallel to each other. The first bottom rod 210 and the top rod 230 are each substantially perpendicular to the first connecting part 222 and the second connecting part 223 in the expanded configuration. The first connecting part 222 and the second connecting part 223 each respectively lock in place at 90° when expanded from the bottom rod 210. Thus, the alignment rod 200 has a square-shaped feature that increases the structural stability thereof.

Figure 22:
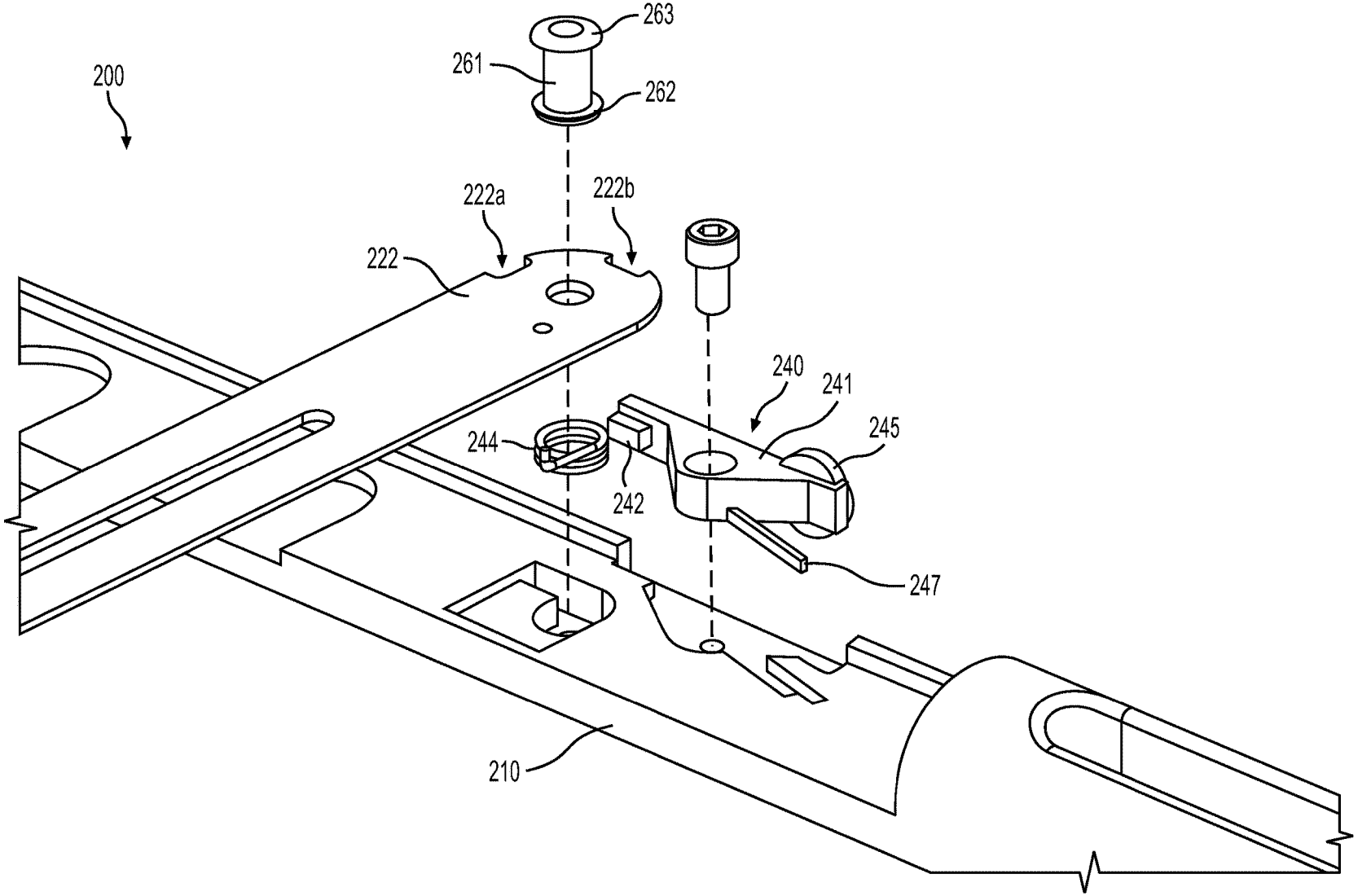
FIG. 22 shows an exploded perspective view of a latch portion of the golf alignment rod of FIG. 19.
Figure 23A:
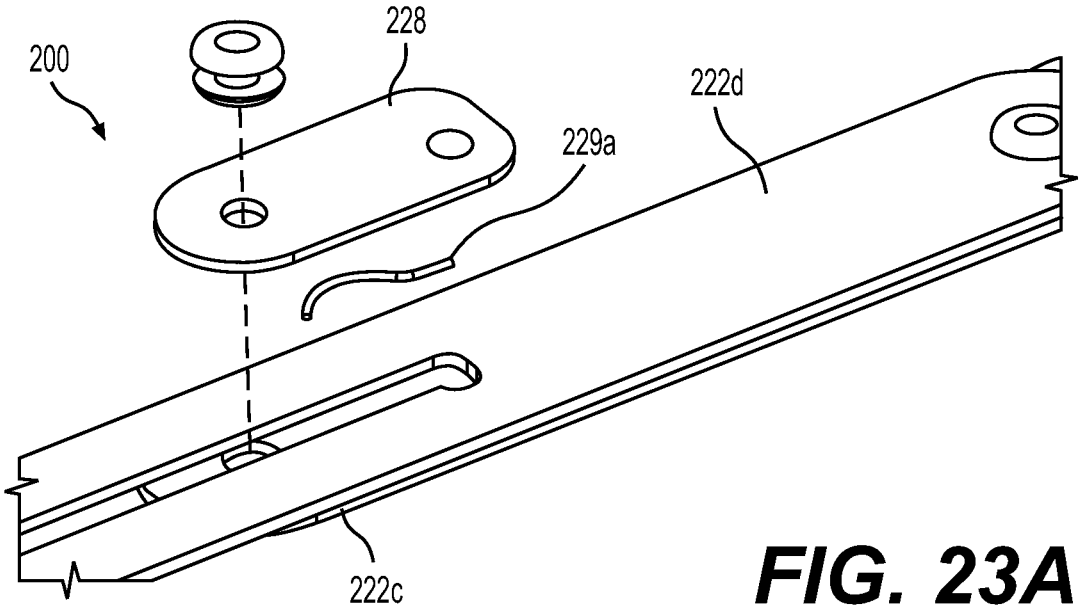
FIG. 23A and FIG. 23B show top and bottom exploded perspective views of a cover plate portion of the golf alignment rod of FIG. 19, respectively.
Figure 23B:
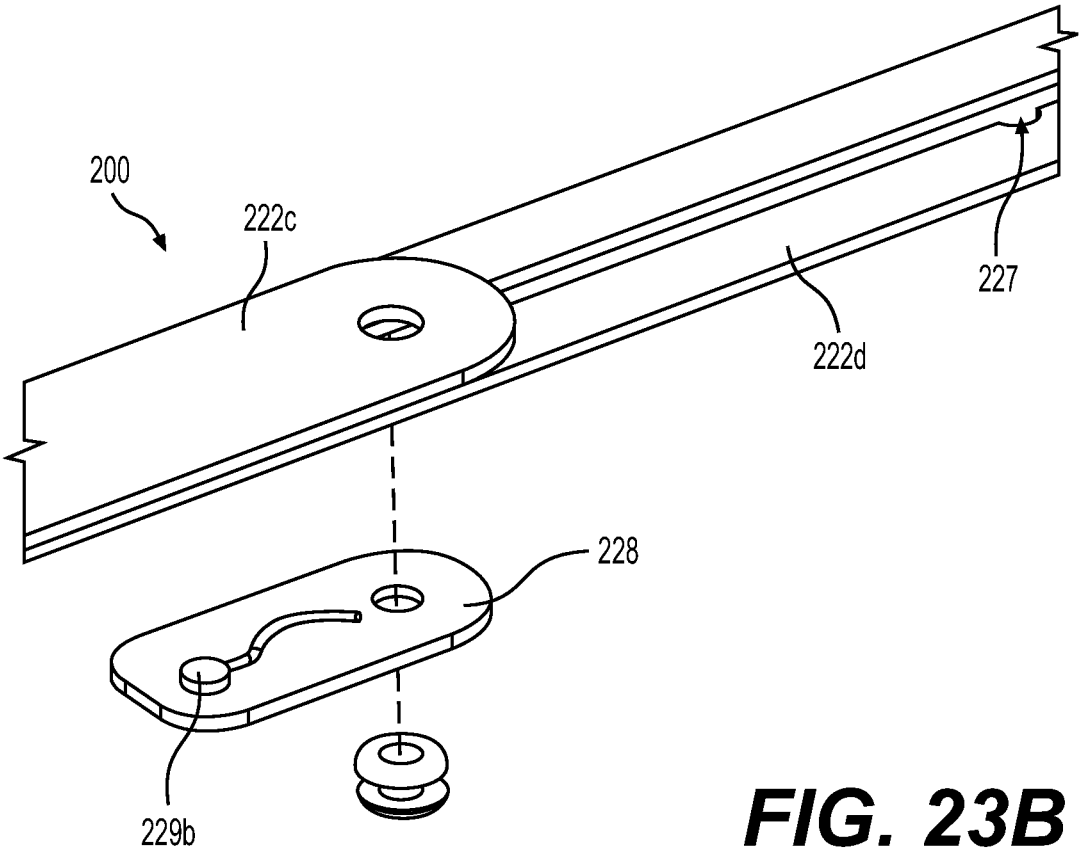

When the first connecting part 222 is expanded, it locks in place at 90° with respect to the bottom rod 210. The first connecting part 222 is initially locked in the collapsed configuration by a latch 240 set in and connected to the bottom rod 210. Magnets 260 are also set in each of the bottom rod 210 and the top rod 230, which overlap and hold the alignment rod 200 in a collapsed configuration. As shown in FIG. 22, the latch 240 has a body 241 with a catch 242 at one end, and the first connecting part 222 has a receiving portion 222*a* for the catch 242. The first connecting part 222 has a circular end that is rotatably connected to the bottom rod 210. When the latch 240 is released by pushing one end thereof, such as a button 245, the catch 242 at the other end is withdrawn from the receiving portion 222*a*. The body 241 has an integrally formed tensioner 247, which ensures the latch 240 returns to its original position when the button 245 is pushed.

The circular end of the first connecting part 222 is connected to a coil spring 244 that is compressed and creates tension when the first connecting part 222 is not extended, that is, when the alignment rod 200 is in the collapsed configuration. The first connecting part 222 is rotatably connected to the bottom rod 210 by a pin 261 with heads 262 and 263. The coil spring 244 is disposed under the first connecting part 222 in the bottom rod 210 and around the pin 261. Thus, when the latch 240 is released and the catch 242 is withdrawn from the receiving portion 222*a*, the tension from the coil spring 244 is released, and the first connecting part 222 rotates 90° to the extended position. Particularly, the first connecting part 222 is configured to automatically rotate 90° to the extended position. The catch 242 extends into a locking portion 222*b* of the first connecting part 222. A second end of the first connecting part 222 is rotatably connected to the top rod 230 by another pin 261.

The second connecting part 223 is configured substantially similarly as the first connecting part 222, as described above, and repeated description is omitted herein. A first end of the second connecting part 223 is rotatably connected to the bottom rod 210, and a second end of the second connecting part 223 is rotatably connected to the top rod 230. As shown in FIG. 19, there may only be one latch 240 connected to the bottom rod 210 to releasably secure the first connecting part 222.

The first connecting part 222 and the second connecting part 223 are extendable. As described above with respect to the alignment rod 1, the alignment rod 200 has a minimum opening width, and a maximum opening width when the first connecting part 222 and the second connecting part 223 are extended and the alignment rod 200 is in an expanded configuration. The first connecting part 222 has a slidable portion 222*c*, and is connected to a tracked portion 222*d*. Both the slidable portion 222*c* and the tracked portion 222*d* have an inset track and are slidably connected by pins, such as pin 261 as described above.

The tracked portion 222*d* has latch holes 227 in the sides thereof, corresponding to the minimum opening width and the maximum opening width of the alignment rod 200. A cover plate 228 is connected over the tracked portion 222*d*, as shown in detail in FIG. 23A and FIG. 23B. The cover plate 288 has a plate tensioner 229*a* and plate pin 229*b*, so that the cover plate 228 is tensionably aligned in the track of the tracked portion 222*d*. The plate pin 229*b* is configured to releasably hold the cover plate 288 in the latch holes 227, and so the first connecting part 222 can extend or collapse between the minimum opening width and the maximum opening width. The latch holes 227 allow the first connecting part 222 to be retained in a desired configuration (that is, collapsed or extended) via the cover plate 228 and plate pin 229*b*, which can be easily released.

The second connecting part 223 may have a substantially equivalent configuration as shown and described with respect to the first connecting part 222. The second connecting part 223 has a slidable portion 223*c* and a tracked portion 223*d* each having an inset track and slidably connected by pins, as described above. Further, although not shown in FIG. 19, the second connecting part 223 has a may have a cover plate 228, plate tensioner 229*a*, and plate pin 229*b*.

The bottom rod 210 has cutaways 212 formed therein, which accommodate connectors used to connect the first connecting part 222 or the second connecting part 223. That is, when the alignment rod 200 is in a collapsed configuration, the cutaways 212 provide space for the connectors inside the bottom rod 210, since the connectors may have a greater cross-sectional width than the first connecting part 222 or the second connecting part 223, as shown in FIG. 24 and FIG. 25.

Further, as shown in FIG. 24 and FIG. 25, there may be additional cutaways 212 formed in the bottom rod 210. These additional cutaways 212 may accommodate reference numbers or user alignment markings (not shown) placed on the bottom rod 210 to help a user set up the same every time in relation to a golf ball. The reference numbers are shown and described above with respect to the alignment rods 1 and 100, in FIG. 4, FIG. 12, and FIG. 13 in particular. Here, the reference numbers or alignment markings inset in the additional cutaways may not be rubbed away as would otherwise occur, and may be easier for a user to view.

The top rod 230 has cutaways 232*a* formed therein, which accommodate connectors used to connect the first connecting part 222 or the second connecting part 223, similarly as described above with respect to the cutaways 212. Further, the top rod 230 has large cutaways 232*b*, which accommodate the cover plates 228. The bottom rod 210 has a first handle spacer 211 formed therethrough, and the top rod 230 has a second handle spacer 231 formed therethrough. The first handle spacer 211 and the second handle spacer 231 are designed to reduce the weight of the alignment rod 200.

Figure 26:
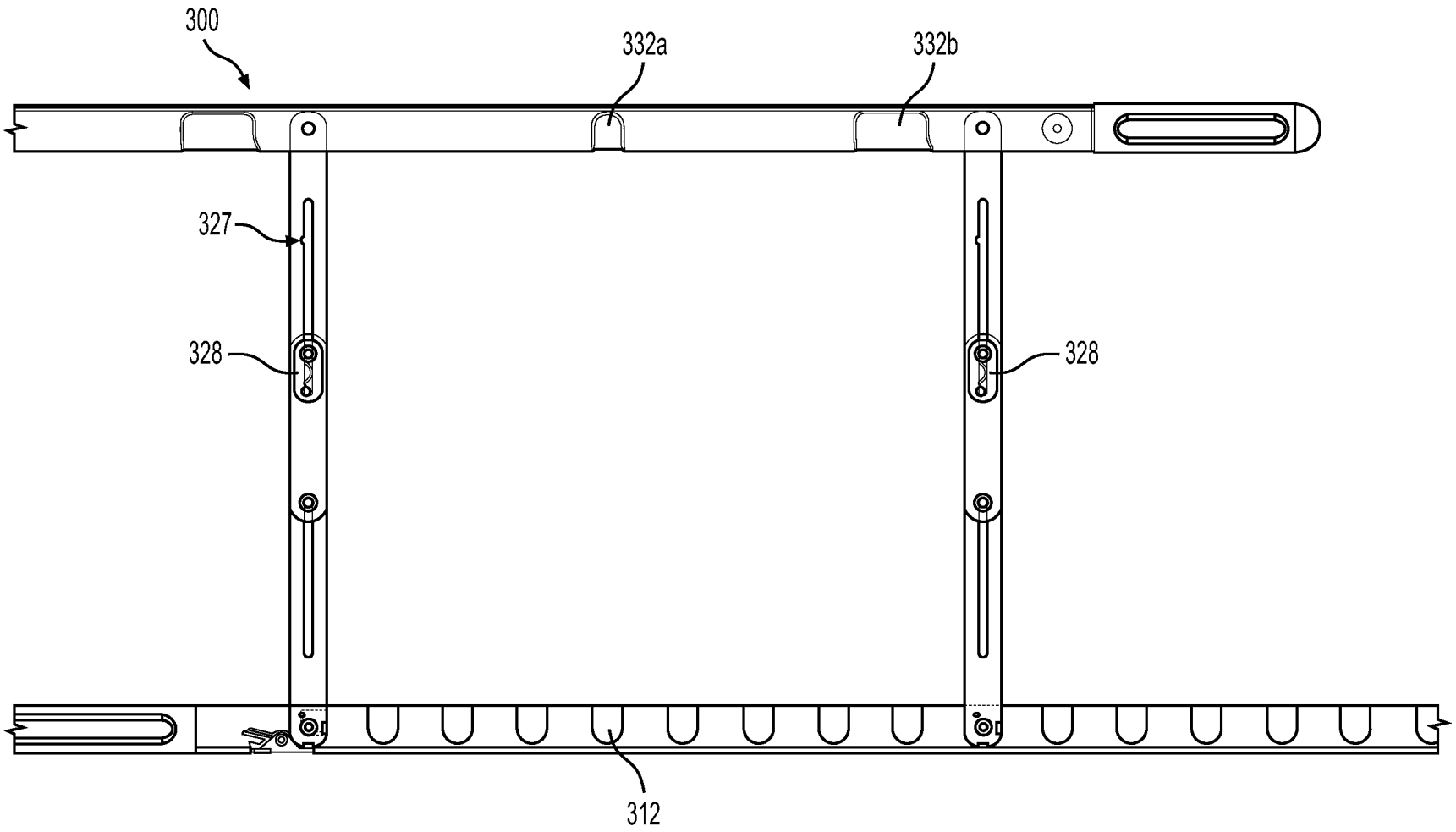
FIG. 26 shows a golf alignment rod according to an exemplary embodiment.

FIG. 26 shows an alignment rod 300 according to an exemplary embodiment, which may be substantially similar in various respects to the alignment rod 1, the alignment rod 100, and the alignment rod 200 as described above, and the disclosure thereof is incorporated herein by reference, and any repeated disclosure may be omitted for the sake of brevity. Likewise, the disclosure with respect to the alignment rod 300 described herein is incorporated by reference into the exemplary embodiments described with respect to FIG. 1 through FIG. 25. Particularly, as shown in FIG. 26, the alignment rod 300 has two cover plates 328, two large cutaways 332*b*, and additional cutaways 312, compared with the alignment rod 200.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

I claim:

1. An alignment rod configured to be used in the sport of golf, comprising:

a first rod and a second rod movably connected to each other; and a first connecting rod and a second connecting rod connecting the first rod and the second rod, wherein:

the first rod and the second rod substantially overlap each other in a collapsed configuration, and the first rod and the second rod are spaced apart from each other in an expanded configuration;

the first rod has a bottom half that is rounded along the length of the alignment rod, and the second rod has a top half that is rounded along the length of the alignment rod, wherein in the collapsed configuration the alignment rod has both a top half and a bottom half that are rounded;

the first connecting rod and the second connecting rod are each connected to a substantially flat top half of the first rod and a substantially flat bottom half of the second rod; and in the collapsed configuration the first connecting rod and the second connecting rod are arranged entirely between the substantially flat top half of the first rod and the substantially flat bottom half of the second rod.

2. The alignment rod of claim 1, wherein in the collapsed configuration the alignment rod has a similar appearance as a golf club.

3. The alignment rod of claim 1, wherein in the expanded configuration, the first connecting rod and the second connecting rod respectively lock in place 90° with respect to the first rod and the second rod.

4. The alignment rod of claim 3, wherein in the expanded configuration:

the first rod and the second rod are substantially parallel to each other;

the first connecting rod and the second connecting rod are substantially parallel to each other; and the first rod and the second rod are each substantially perpendicular to the first connecting rod and the second connecting rod.

5. The alignment rod of claim 1, further comprising a latch disposed in and connected to the first rod, wherein the latch comprises a latch body having a catch at a first end thereof and a button at a second end thereof, wherein the first connecting rod comprises a receiving portion configured to receive the catch and a locking portion.

6. The alignment rod of claim 5, wherein in the collapsed configuration, the latch is configured to be released by a user pushing the button, whereby the catch is configured to be withdrawn from the receiving portion of the first connecting rod.

7. The alignment rod of claim 6, wherein the first connecting rod is tensionably and rotatably connected to the first rod, and in the collapsed configuration, when the latch is released and the catch is withdrawn from the receiving portion of the first connecting rod, the first connecting rod is configured to automatically rotate 90° to the expanded configuration.

8. The alignment rod of claim 7, wherein after the first connecting rod rotates 90° to the expanded configuration, the catch is configured to extend into the locking portion of the first connecting rod, thereby locking the first connecting rod in place with respect to the first rod.

9. The alignment rod of claim 1, wherein the alignment rod comprises a first cross-sectional thickness, and the first rod, the second rod, the first connecting rod, and the second connecting rod together comprise a second cross-sectional thickness substantially equal to the first cross-sectional thickness.

10. The alignment rod of claim 9, wherein in the collapsed configuration the first rod, the second rod, the first connecting rod, and the second connecting rod substantially overlap along a cross-sectional axis of the alignment rod.

11. The alignment rod of claim 1, wherein the first connecting rod is extendable, the first connecting rod comprising a tracked portion having a track therein, a slidable portion connected to a first side of the tracked portion, and a cover plate connected to a second side of the tracked portion opposite to the first side thereof.

12. The alignment rod of claim 11, wherein the tracked portion comprises a first latch hole therein corresponding to a minimum opening width configuration of the alignment rod, and a second latch hole therein corresponding to a maximum opening width configuration of the alignment rod.

13. The alignment rod of claim 12, wherein the cover plate comprises a plate tensioner and a plate pin, and the cover plate is connected over the tracked portion, wherein the plate tensioner and the plate pin are tensionably aligned in the track of the tracked portion.

14. The alignment rod of claim 13, wherein the plate pin is configured to releasably hold the cover plate in the first latch hole or the second latch hole, whereby the first connecting rod is configured to extend or collapse between the minimum opening width configuration and the maximum opening width configuration, respectively.

15. The alignment rod of claim 14, wherein the first latch hole and the second latch hole are configured to retain the first connecting rod in the minimum opening width configuration or the maximum opening width configuration, respectively, via the cover plate and the plate pin.

16. An alignment rod configured to be used in the sport of golf, comprising:

a first rod and a second rod movably connected to each other;

a first connecting rod and a second connecting rod connecting the first rod and the second rod; and a latch disposed in and connected to the first rod, wherein:

the first rod and the second rod substantially overlap each other in a collapsed configuration, and the first rod and the second rod are spaced apart from each other in an expanded configuration;

the first rod has a bottom half that is rounded along the length of the alignment rod, and the second rod has a top half that is rounded along the length of the alignment rod, wherein in the collapsed configuration the alignment rod has both a top half and a bottom half that are rounded;

the latch comprises a latch body having a catch at a first end thereof and a button at a second end thereof;

the first connecting rod comprises a receiving portion configured to receive the catch and a locking portion;

in the collapsed configuration, the latch is configured to be released by a user pushing the button, whereby the catch is configured to be withdrawn from the receiving portion of the first connecting rod;

the first connecting rod and the second connecting rod are each connected to a substantially flat top half of the first rod and a substantially flat bottom half of the second rod; and in the collapsed configuration the first connecting rod and the second connecting rod are arranged entirely between the substantially flat top half of the first rod and the substantially flat bottom half of the second rod.

17. An alignment rod configured to be used in the sport of golf, comprising:

a first rod and a second rod movably connected to each other;

a first connecting rod and a second connecting rod connecting the first rod and the second rod;

a latch disposed in and connected to the first rod; and a spring disposed under the first connecting rod in the first rod, wherein:

the first rod and the second rod substantially overlap each other in a collapsed configuration, and the first rod and the second rod are spaced apart from each other in an expanded configuration;

the first rod has a bottom half that is rounded along the length of the alignment rod, and the second rod has a top half that is rounded along the length of the alignment rod, wherein in the collapsed configuration the alignment rod has both a top half and a bottom half that are rounded;

the latch comprises a latch body having a catch at a first end thereof and a button at a second end thereof;

the first connecting rod comprises a receiving portion configured to receive the catch and a locking portion;

in the collapsed configuration, the latch is configured to be released by a user pushing the button, whereby the catch is configured to be withdrawn from the receiving portion of the first connecting rod;

the first connecting rod is tensionably and rotatably connected to the first rod by the spring, and in the collapsed configuration, when the latch is released and the catch is withdrawn from the receiving portion of the first connecting rod, the first connecting rod is configured to automatically rotate 90° to the expanded configuration;

the first connecting rod and the second connecting rod are each connected to a substantially flat top half of the first rod and a substantially flat bottom half of the second rod; and in the collapsed configuration the first connecting rod and the second connecting rod are arranged entirely between the substantially flat top half of the first rod and the substantially flat bottom half of the second rod.

* * * * *